US010157560B2

(12) United States Patent
Yang et al.

(10) Patent No.: US 10,157,560 B2
(45) Date of Patent: Dec. 18, 2018

(54) DISPLAY PANEL AND DISPLAY DRIVER

(71) Applicant: Novatek Microelectronics Corp., Hsinchu (TW)

(72) Inventors: Hsueh-Yen Yang, Taoyuan (TW); Kai-Min Yang, Kaohsiung (TW); Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 43 days.

(21) Appl. No.: 14/735,158

(22) Filed: Jun. 10, 2015

(65) Prior Publication Data

US 2016/0217764 A1 Jul. 28, 2016

(30) Foreign Application Priority Data

Jan. 27, 2015 (TW) ..... 104102672 A

(51) Int. Cl.
*G09G 5/02* (2006.01)
*G09G 3/20* (2006.01)

(52) U.S. Cl.
CPC ... *G09G 3/2003* (2013.01); *G09G 2300/0452* (2013.01); *G09G 2310/0254* (2013.01); *G09G 2340/0457* (2013.01)

(58) Field of Classification Search
CPC ..... G09G 3/2074; G09G 2300/0443; G09G 2300/0452; G09G 5/024; G09G 5/28; G09G 3/3648; G09G 3/3607; G09G 3/3614; G09G 2300/08
See application file for complete search history.

(56) References Cited

U.S. PATENT DOCUMENTS 7,187,353 B2 3/2007 Credelle et al.
7,352,374 B2 4/2008 Brown Elliott et al.
8,031,205 B2 10/2011 Brown Elliott et al.
(Continued)

FOREIGN PATENT DOCUMENTS

CN 1495493 5/2004
CN 101582244 11/2009
(Continued)

OTHER PUBLICATIONS

"Office Action of Taiwan Counterpart Application," dated Mar. 28, 2016, p. 1-p. 4.
(Continued)

*Primary Examiner* — Robert Michaud
(74) *Attorney, Agent, or Firm* — JCIPRNET

(57) ABSTRACT

A display panel and a display driver are provided. The display panel includes a plurality of sub-pixel repeating units, which are arranged repeatedly to form a pixel array. Each row of the sub-pixel repeating unit includes an odd number of sub-pixels, where every two sub-pixels are regarded as one pixel unit, and another sub-pixel is added at the last column of the sub-pixel repeating unit. The odd-numbered sub-pixels are respectively written by N groups of pixel data. The amount of these sub-pixels is 2N+1, which is between two to two and a half times of the amount of the pixel data. Each odd-numbered column of the sub-pixel repeating unit includes the sub-pixels of two different colors, which are alternately arranged in each odd-numbered column.

21 Claims, 18 Drawing Sheets

(56) References Cited

U.S. PATENT DOCUMENTS

| | | | | |
|---|---|---|---|---|
| 8,203,582 | B2 | 6/2012 | Elliott et al. | |
| 8,502,839 | B2 | 8/2013 | Tseng et al. | |
| 9,035,980 | B2 | 5/2015 | Yang et al. | |
| 9,182,626 | B2 | 11/2015 | Kim | |
| 9,214,134 | B2 | 12/2015 | Yang et al. | |
| 2004/0169807 | A1* | 9/2004 | Rho | G02F 1/133514 349/139 |
| 2004/0196297 | A1 | 10/2004 | Elliott et al. | |
| 2008/0049048 | A1* | 2/2008 | Credelle | G09G 3/2074 345/690 |
| 2008/0158243 | A1 | 7/2008 | Brown Elliott et al. | |
| 2008/0186325 | A1* | 8/2008 | Higgins | G06T 11/001 345/592 |
| 2008/0252558 | A1 | 10/2008 | Kim et al. | |
| 2008/0252581 | A1* | 10/2008 | Brown Elliott | G02F 1/1368 345/88 |
| 2009/0073099 | A1 | 3/2009 | Yeates et al. | |
| 2009/0135207 | A1 | 5/2009 | Tseng et al. | |
| 2012/0001965 | A1* | 1/2012 | Credelle | G09G 3/3614 345/694 |
| 2012/0139965 | A1 | 6/2012 | Yang | |
| 2012/0268357 | A1 | 10/2012 | Shih et al. | |
| 2013/0070006 | A1 | 3/2013 | Yang et al. | |
| 2013/0148060 | A1 | 6/2013 | Kim | |
| 2014/0313244 | A1 | 10/2014 | Yang et al. | |
| 2014/0362127 | A1 | 12/2014 | Yang et al. | |

FOREIGN PATENT DOCUMENTS

| | | |
|---|---|---|
| CN | 101814283 | 8/2010 |
| CN | 102054435 | 5/2011 |
| TW | 200426750 | 12/2004 |
| TW | 200511175 | 3/2005 |
| TW | 200912834 | 3/2009 |
| TW | 200923879 | 6/2009 |
| TW | 200945256 | 11/2009 |
| TW | 201243465 | 11/2012 |
| TW | 201314657 | 4/2013 |
| TW | 201324492 | 6/2013 |
| TW | 201442005 | 11/2014 |
| TW | 201447427 | 12/2014 |

OTHER PUBLICATIONS

"Office Action of China Counterpart Application," dated Aug. 3, 2018, pp. 1-5.

* cited by examiner

DISPLAY PANEL AND DISPLAY DRIVER

CROSS-REFERENCE TO RELATED APPLICATION

This application claims the priority benefit of Taiwan application serial no. 104102672, filed on Jan. 27, 2015. The entirety of the above-mentioned patent application is hereby incorporated by reference herein and made a part of this specification.

BACKGROUND OF THE INVENTION

1. Field of the Invention

The invention generally relates to a flat panel display technology, and more particularly, to display panel that is applied with a sub-pixel rendering technology and is capable of increasing coloring resources, and a display driver thereof.

2. Description of Related Art

With the rapid development of display technology, current market performance requirements for display panel move towards high resolution, high brightness, low power consumption and so forth. However, as the resolution of the display panel increases, panel makers may encounter the following problems. For instance, complexity of advanced pixel circuits would cause the number of thin film transistors in the layout to increase and would occupy a certain amount of layout area, and thus it would result in difficulties if hoping to attain a high resolution image display under limited layout area. Further, under the consideration of manufacturing process conditions, if different design rules are being used on the manufacturing process of the display or being limited by the minimum safety distance of a fine metal mask, realization of the high resolution display would also be influenced. Moreover, in terms of display performance, the increase in resolution will lower the aperture ratio of the display, and thereby result in the lowering of the backlight transmittance. Hence, the luminance of backlight source must be raised in response to the lowering of the aperture ratio, but it would result in the increase in power loss.

In order to solve the abovementioned problems, RGBW display panel, which is capable of enhancing the backlight transmittance and lowering backlight power consumption, has been developed in recent years. The RGBW display panel has sub-pixels of four colors, e.g., red, green, blue and white, and the brightness of the display panel is enhanced by the high transmittance of the white sub-pixel, and in combination with sub-pixel rendering (SPR), different sub-pixel arrangements and designs have been used to develop appropriate algorithms for raising the resolution during the image display into the sub-pixel resolution. Since the size of the sub-pixel is smaller than that of the pixel, it allows human eyes to see the enhancement of the image resolution (i.e., visual resolution).

However, the sub-pixel rendering technology often requires to analyze the adjacent pixel data. For a display panel having large size and high resolution, a plurality of driving circuits are often configured to respectively drive a plurality of display region on the display panel. In terms of the pixels nearby the edges of the display regions, the driving circuits thereof must transfer pixel data mutually with a corresponding driving circuit in the adjacent display region. An additional memory space is required for storing the pixel data, thereby causing the design of the driving circuits to be more complicated. Thus, how to simplify the architecture of the driving circuits, as well as attaining the design of high resolution display panel, has currently become one of the problems to be solved.

SUMMARY OF THE INVENTION

The invention provides a display panel and a display driver thereof, which are capable of increasing coloring resources required for sub-pixel rendering, simplifying a design of driving circuits and improving a problem of display screen flickering, thereby achieving a design of having high resolution and favorable display effect.

The invention provides a display panel. The display panel includes a plurality of sub-pixel repeating units, which are arranged repeatedly to form a pixel array. Each row of each of the sub-pixel repeating units includes an odd number of sub-pixels, where every two sub-pixels are regarded as one pixel unit and another sub-pixel is added to the last column of the sub-pixel repeating unit. The odd-numbered sub-pixels are respectively written by N groups of pixel data, wherein the amount of the sub-pixel is (2N+1), and the amount of the sub-pixel is between two to two and a half times of the amount of the pixel data. Each odd-numbered column of each of the sub-pixel repeating units includes the sub-pixels of two different colors, which are alternately arranged in each odd-numbered column.

In one embodiment of the invention, on the display panel, the sub-pixels of a same color respectively have different polarities.

In one embodiment of the invention, each of the sub-pixel repeating units includes the sub-pixels of three different colors, each odd-numbered column of each of the sub-pixel repeating units includes at least one first color sub-pixel and at least one third color sub-pixel for being staggeredly arranged, and each even-numbered column of each of the sub-pixel repeating units includes at least one second color sub-pixel so as to form a striped arrangement In one embodiment of the invention, the first color sub-pixel, the second color sub-pixel and the third color sub-pixel are respectively one of a red sub-pixel, a green sub-pixel and a blue sub-pixel.

In one embodiment of the invention, each of the sub-pixel repeating units includes the sub-pixels of four different colors, each odd-numbered column of each of the sub-pixel repeating unit includes at least one first color sub-pixel and at least one third color sub-pixel for being staggeredly arranged, and at least one even-numbered column of each of the sub-pixel repeating units includes at least one second color sub-pixel and at least one fourth color sub-pixel for being arranged.

In one embodiment of the invention, a spatial frequency of the second color sub-pixel and the fourth color sub-pixel in the at least one even-numbered column of each of the sub-pixel repeating units is 1:1.

In one embodiment of the invention, a spatial frequency of the second color sub-pixel and the fourth color sub-pixel in the at least one even-numbered column of each of the sub-pixel repeating units is 1:3.

In one embodiment of the invention, the first color sub-pixel, the second color sub-pixel, the third color sub-pixel and the fourth color sub-pixel are respectively one of a red sub-pixel, a green sub-pixel, a blue sub-pixel and a white sub-pixel.

The invention provides a display driver. The display driver is configured to drive a display panel. The display panel includes a plurality of sub-pixel repeating units. The sub-pixel repeating units are divided into at least two sub-pixel groups. The display driver includes a first driving circuit and a second driving circuit. The first driving circuit is configured to drive a first sub-pixel group in the sub-pixel groups. The second driving circuit is configured to drive a second sub-pixel group adjacent to a last odd-numbered column of the first sub-pixel group in the sub-pixel groups. The last odd-numbered column of the first sub-pixel group includes a first sub-pixel and a second sub-pixel. In the first sub-pixel group, a first pixel unit adjacent to the first sub-pixel is written by a first group of pixel data. The first driving circuit drives the first sub-pixel of the first sub-pixel group according to the first group of pixel data, so as to color mix the first sub-pixel with the first pixel unit. In the first sub-pixel group, a second pixel unit adjacent to the second sub-pixel is written by a second group of pixel data in the pixel data. The first driving circuit drives the second sub-pixel of the first sub-pixel group according to the second group of pixel data, so as to color mix the first sub-pixel with the second pixel unit.

In one embodiment of the invention, the sub-pixel repeating units are arranged repeatedly to foil a pixel array. The sub-pixel repeating units are divided into the at least two sub-pixel groups along a row direction. Each row of each of the sub-pixel repeating unit includes an odd number of sub-pixels. Every two sub-pixels are regarded as one pixel unit, and another sub-pixel is added at the last column of the sub-pixel repeating unit. The odd-numbered sub-pixels are respectively written by N groups of pixel data. The amount of the sub-pixels is (2N+1), and the amount of the sub-pixels is between two to two and a half times of the amount of the pixel data.

In one embodiment of the invention, the first sub-pixel and the second sub-pixel are of different colors.

In one embodiment of the invention, the sub-pixel repeating units include a first sub-pixel repeating unit and a second sub-pixel repeating unit, the last odd-numbered column of the first sub-pixel repeating unit is arranged to be adjacent to the second sub-pixel repeating unit, and an arrangement of the sub-pixels in the first sub-pixel repeating unit is the same as that of the sub-pixels in the second sub-pixel repeating unit.

In one embodiment of the invention, odd-numbered rows and even-numbered rows in the second sub-pixel repeating unit are staggeredly arranged with odd-numbered rows and even-numbered rows in the first sub-pixel repeating unit.

In one embodiment of the invention, on the display panel, the sub-pixels of a same color respectively have different polarities.

In one embodiment of the invention, each odd-numbered column of each of the sub-pixel repeating units includes the sub-pixels of two different colors, which are alternately arranged in each odd-numbered column.

In one embodiment of the invention, each of the sub-pixel repeating units includes the sub-pixels of three different colors, each odd-numbered column of each of the sub-pixel repeating units includes at least one first color sub-pixel and at least one third color sub-pixel for being staggeredly arranged, and each even-numbered column of each of the sub-pixel repeating units includes at least one second color sub-pixel so as to form a striped arrangement.

In one embodiment of the invention, the first color sub-pixel, the second color sub-pixel and the third color sub-pixel are respectively one of a red sub-pixel, a green sub-pixel and a blue sub-pixel.

In one embodiment of the invention, each of the sub-pixel repeating units includes the sub-pixels of four different colors, each odd-numbered column of each of the sub-pixel repeating unit includes at least one first color sub-pixel and at least one third color sub-pixel for being staggeredly arranged, and at least one even-numbered column of each of the sub-pixel repeating unit includes at least one second color sub-pixel and at least one fourth color sub-pixel for being arranged.

In one embodiment of the invention, a spatial frequency of the second color sub-pixel and the fourth color sub-pixel in the at least one even-numbered column of each of the sub-pixel repeating units is 1:1.

In one embodiment of the invention, a spatial frequency of the second color sub-pixel and the fourth color sub-pixel in the at least one even-numbered column of each of the sub-pixel repeating unit is 1:3.

In one embodiment of the invention, the first color sub-pixel, the second color sub-pixel, the third color sub-pixel and the fourth color sub-pixel are respectively one of a red sub-pixel, a green sub-pixel, a blue sub-pixel and a white sub-pixel.

In view of the above, in the embodiments of the invention, the display panel and the display driver thereof, through adding an extra sub-pixel in each row of the sub-pixel repeating unit, enable each of the sub-pixel repeating units to use its own sub-pixels as the coloring resources, and thus it is not necessary to borrow color from the sub-pixel of other sub-pixel repeating unit. Under such design, each row of the sub-pixel repeating unit includes an odd number of sub-pixels and enables the sub-pixels of the same color on the display panel to have different polarities, and thus the problem of display screen flickering caused by having same polarity can be improved. Moreover, from the point of view of a driving terminal of the display apparatus, the extra sub-pixel can form a break point on the display panel, and thus it is not necessary to transfer data between each of the drivers, thereby achieving a simple design of the driving circuits.

In order to make the aforementioned features and advantages of the present invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

In the embodiments of the invention, a display panel and a display driver thereof, based on sub-pixel technology, are provided, in which an extra sub-pixel is added at each row of sub-pixel repeating units, so that when pixel data are being written into the sub-pixel repeating units, each of the sub-pixel repeating units can use its own sub-pixels as coloring resources, and thus it is not necessary to borrow color from the sub-pixel of other sub-pixel repeating unit to perform display. Particularly, from the point of view of a driving terminal, the extra sub-pixel may form a break point on the display panel, so that the embodiments of the invention may further avoid the needs of data transferring between each of the driving circuits, thereby effectively simplifying the complicated design of the driving circuits. Moreover, in the embodiments of the invention, under an arrangement design where each row of the sub-pixel repeating units includes an odd number of sub-pixels, the sub-pixels of a same color on the display panel may have different polarities, and thus the problem of display screen flickering caused by having same polarity can be improved.

Figure 1:
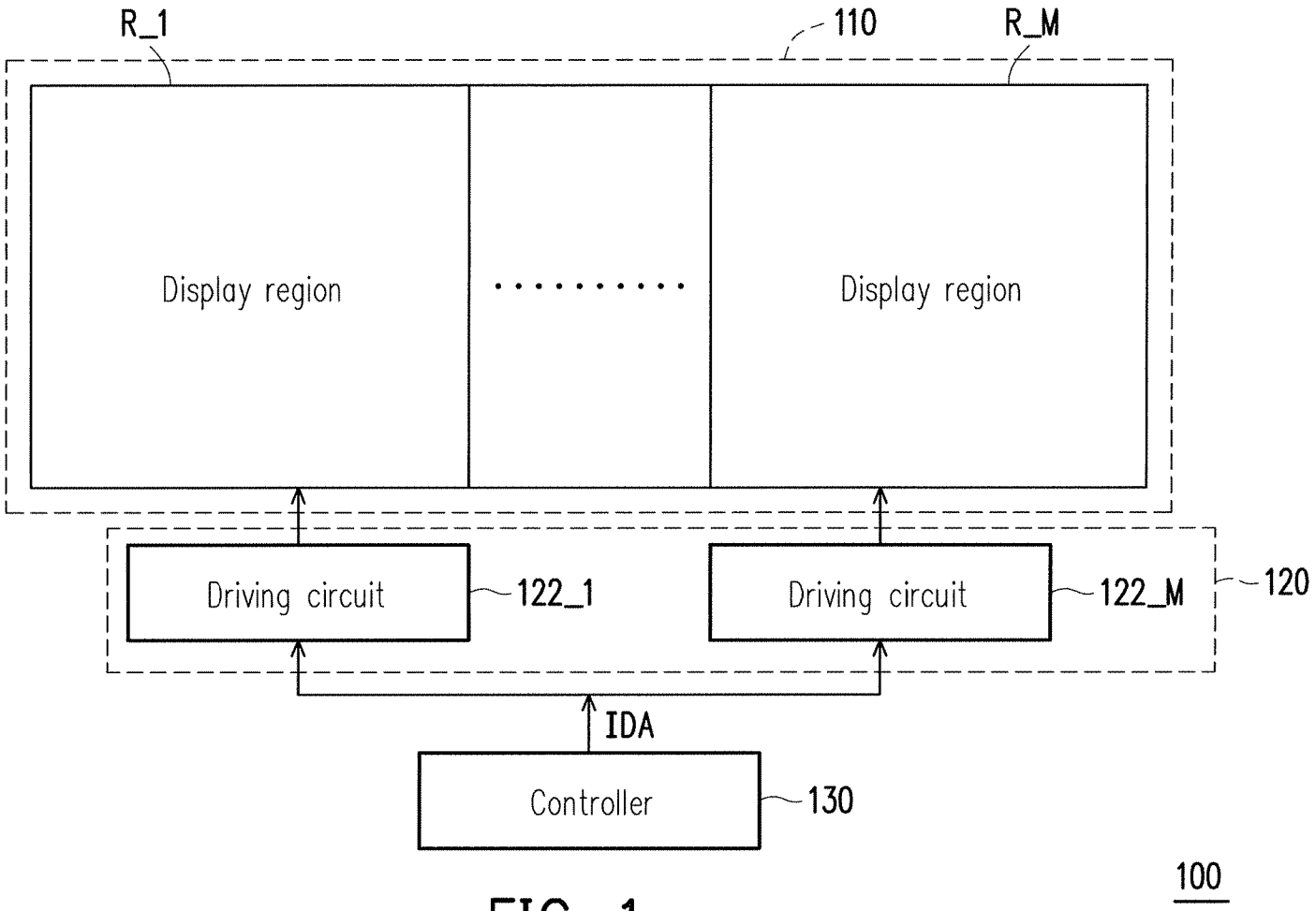
FIG. 1 is a schematic view of a display apparatus illustrated according to one embodiment of the invention.
Figure 2:
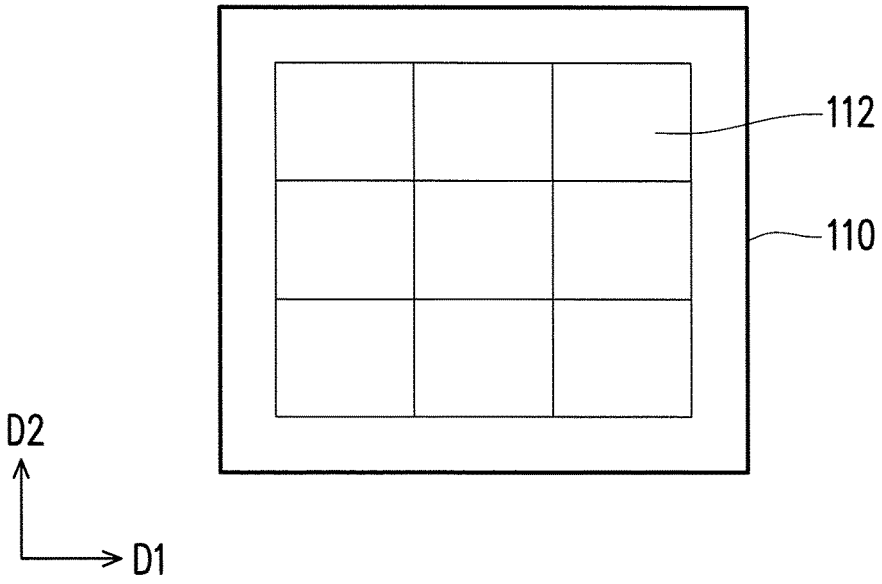
FIG. 2 is a schematic top view of a display panel illustrated according to one embodiment of the invention.

Firstly, using FIG. 1 and FIG. 2 to explain the device architecture of the embodiments in the invention, wherein FIG. 1 is a schematic view of a display apparatus illustrated according to one embodiment of the invention, and FIG. 2 is a schematic top view of a display panel illustrated according to one embodiment of the invention.

Referring to FIG. 1, a display apparatus 100 includes a display panel 110, a driver 120 and a controller 130. The driver 120 includes a plurality of driving circuits 122_1 to 122_M, which are respectively coupled to the display panel 110. The display panel 110 includes a plurality of display regions R_1 to R_M, which are respectively configured with a plurality of pixels (not shown in FIG. 1) thereon. The driving circuits 122_1 to 122_M are respectively corresponded to the display regions R_1 to R_M on the display panel 110, and the driving circuits 122_1 to 122_M are respectively configured to drive the display panel 110 so as to enable the display regions R_1 to R_M to generate images, respectively.

The controller 130 is coupled to the driving circuits 122_1 to 122_M, and the controller 130 is configured to transfer display data IDA to the driving circuits 122_1 to 122_M. The display data IDA may provide data for displaying a whole picture to the display panel 110. It is to be noted that, each of the driving circuits 122_1 to 122_M can only receives one of a plurality of portions of data in the display data IDA. In simple terms, the display data IDA may be divided into multiple portions of data according to the corresponding display regions R_1 to R_M, and the driving circuits 122_1 to 122_M thus receive the multiple portions of data from the corresponding display regions R_1 to R_M, respectively.

Next, the display panel 110 is further described. Referring to FIG. 2, the display panel 110, for example, includes a plurality of sub-pixel repeating units 112. For the convenience of explanation, FIG. 2 only schematically illustrates 9 sub-pixel repeating units 112 that are arranged in a 3×3 array, but the invention does not intend to limit the amount of the sub-pixel repeating units 112 on the display panel 110. These sub-pixel repeating units 110 are arranged repeatedly on the display panel 100 to form the display regions R_1 to R_M shown FIG. 1. The sub-pixel repeating units 112, for example, are arranged in a second direction D2 along a first direction D1, thereby forming a matrix array with multiple columns and multiple rows; the invention is not limited thereto. The rows and the columns of the said array are merely used for describing the relative positions in an array arrangement; in other words, the rows and the columns of the array can be swapped, and after the rows and the columns are swapped, an array equivalent to flipping the original array by 90 degrees may be obtained. In addition, those who implement the present embodiment can also adjust the number of rows, the number of columns and the arrangement directions of the rows and the columns (i.e., the first direction D1 and the second direction D2) in the array based on the requirements of design; the invention is not limited thereto.

Each of the sub-pixel repeating units 112 of the display panel 110 may include a plurality of sub-pixels therein. In the present embodiment, a length of each sub-pixel in the first direction D1 can be designed as the same as in the second direction D2. In other words, the lengths of each sub-pixel in the first direction D1 and in the second direction D2 can respectively be determined with respect to the dimensions of the sub-pixel repeating unit 112; and those who implement the present embodiment can adaptively adjust the dimensions of the sub-pixel repeating unit 112 in the first direction D1 and in the second direction D2 based on the needs thereof; the invention is not limited thereto.

Moreover, in other embodiments, the size of each sub-pixel can also be different. It is to be explained, the layout dimensions of the said sub-pixel can be described in units of pitch P, and the pitch P can be corresponded to the resolution of the display panel 110. For instance, when the pitch P is 84 um, the resolution may be 303 PPI (pixel per inch; namely, the amount of pixel structures in each inch), and when the pitch P is 58 um, the resolution may be 440 PPI.

The sub-pixels can be corresponded to different display wavelengths to respectively display different colors. In some embodiments, each of the sub-pixel repeating units 112, for example, includes the sub-pixels of three different colors, which include a red pixel R, a green pixel G and a blue pixel B. In other embodiments, each of the sub-pixel repeating units 112 can include the sub-pixels of four different colors, which include a red pixel R, a green pixel G, a blue pixel B and a white pixel W. In the sub-pixel repeating unit 112, the sub-pixels are, for example, respectively arranged into multiple rows and multiple columns in the second direction D2 along the first direction D1. It is to be explained that, in other embodiments, the said sub-pixels of different colors may be swapped, or may also be consisted of other suitable colors or combinations; the invention is not limited thereto.

In addition, the sub-pixel repeating units 112 can be applied into any proper display apparatus 100, such as a liquid crystal display apparatus, a transparent display apparatus, an organic electroluminescent display apparatus, or an electrophoretic display apparatus, etc; and based on different types of the display apparatus 100, the sub-pixel structures in the sub-pixel repeating units 112 may also be adaptively adjusted; the invention is also not limited thereto.

Based on the above-described architecture, detailed configurations of the sub-pixel repeating unit 112 are further described in the following.

In one embodiment, each row of the sub-pixel repeating unit 112 may include an odd number of sub-pixels, where every two sub-pixels are regarded as one pixel unit and another sub-pixel is added at the last column of the sub-pixel repeating unit 112, and the odd-numbered sub-pixels are respectively written by N groups of pixel data. The amount of the sub-pixels is (2N+1), and is between two to two and a half times of the amount of the pixel data. In addition, each odd-numbered column of the sub-pixel repeating unit 112 includes the sub-pixels of two different colors, which are alternately arranged in each odd-numbered column. In the following descriptions, the term 'alternately arranged' or 'staggeredly arranged' indicates an arrangement in which two sub-pixels are arranged in turns, such as an alternating arrangement of the sub-pixels of two different colors (i.e., placing one sub-pixel of a different color between two sub-pixels of a same color, so that the two sub-pixels of the same color are not adjacent to each other), or an alternating arrangement of two row or two columns.

Specifically, as compared to the display data that are used for displaying the whole picture, the pixel data are referred to the data that are to be displayed by being respectively mapped onto the plurality of pixel units on the display panel 110 after being processed by the controller 130 according to an algorithm. Namely, the controller 130 may write the pixel data into the sub-pixels on the display panel 110 through controlling the driver 120.

Further, a group of pixel data may, for example, include image signals of three colors, including red, green and blue; and the pixel unit may be constituted by the sub-pixels of two of the three colors that are configured to display red, green and blue colors. Therefore, in the present embodiment, the controller 130 may map the pixel data that include the image signals of three colors onto the pixel unit constituted by the sub-pixels, which are configured to display two of the colors (e.g., red and green), and may control at least one driving circuit in the driver 120 (e.g., at least one of the driving circuits 122_1 to 122_M) to drive the sub-pixel, which is adjacent to this pixel unit and is configured for displaying the third color (e.g., blue), so as to provide the color mixing for performing display.

Figure 3:
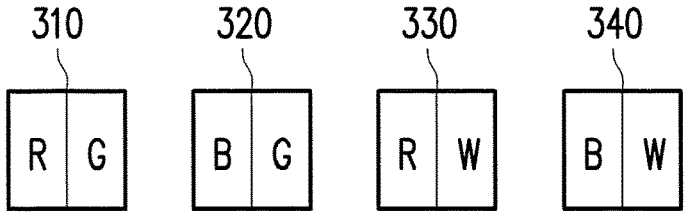
FIG. 3 is a schematic top view of pixel units illustrated according to one embodiment of the invention.

Examples of the pixel units formed by four different sub-pixel combinations are provided herein. FIG. 3 is a schematic top view of pixel units illustrated according to one embodiment of the invention. A pixel unit 310 may be constituted by a red pixel R and a green pixel G, a pixel unit 320 may be constituted by a blue pixel B and a green pixel G, a pixel unit 330 may be constituted by a red pixel R and a white pixel W, and a pixel unit 340 may be constituted by a blue pixel B and a white pixel W. Those who implement the present embodiment can adjust the said combinations based the requirements of design; the invention is not limited thereto.

Therefore, in the embodiments of the invention, based on the aforementioned pixel units 310 to 340, the sub-pixels of different colors can be arranged into a variety of designs on the display panel 110 according to different rules. In addition, an extra sub-pixel is further added at each row of the sub-pixel repeating unit 112, so that, with the design of including an odd number of sub-pixels in each row, the sub-pixel repeating unit 112 can use its own sub-pixels to provide the color mixing of each pixel unit when the pixel data are written into the sub-pixel repeating unit 112.

According to the configuration of the aforementioned sub-pixel repeating unit 112, the amount of sub-pixels in each row (i.e., the number of columns of the sub-pixel repeating unit 112) may have a corresponding relationship with the amount of the pixel data that are written into the row. When each row of the sub-pixel repeating unit 112 includes N pixel units and 1 extra sub-pixel, it indicates that N groups of pixel data can be written into the row. And, since the pixel unit is constituted by two sub-pixels, each row of the sub-pixel repeating unit 112 may include 2N+1 (i.e., an odd number of) sub-pixels. On the other hand, from the point of view of the pixel data, each group of the pixel data is substantially being written with 2+1/N sub-pixels. In other words, in each row of the sub-pixel repeating unit 112, the amount of the sub-pixels (which is 2N+1) may be between two to two and a half times of the amount of the pixel data (which is N).

It is to be noted that, through using the sub-pixels of three or four colors, the sub-pixel repeating units 112 can correspondingly form different arrangements. Specifically, in some embodiments, when each of the sub-pixel repeating units 112 includes the sub-pixels of three different colors, each odd-numbered column of each of the sub-pixel repeating units 112 may include at least one first color sub-pixel and at least one third color sub-pixel for being staggeredly arranged, and each even-numbered column of each of the sub-pixel repeating units 112 may include at least one second color sub-pixel so as to form a striped arrangement. The first color, the second color and the third color sub-pixel are, for example, respectively one of the red, green and blue sub-pixels (i.e., the red pixel R, the green pixel G and the blue pixel B).

For the condition where each of the sub-pixel repeating unit 112 includes the sub-pixels of four different colors, in some embodiments, each odd-numbered column of each of the sub-pixel repeating units 112 may include at least one first color sub-pixel and at least one third color sub-pixel for being staggeredly arranged, and at least one even-numbered column of each of the sub-pixel repeating units 112 may include at least one second color sub-pixel and at least one fourth color sub-pixel for being arranged. The first color, the second color, the third color and the fourth color sub-pixels are, for example, respectively one of the red, green, blue and white sub-pixels (i.e., the red pixel R, the green pixel G, the blue pixel B and the white pixel W). In the following, an embodiment, in which the first color, the second color, the third color and the fourth color sub-pixels are respectively being the red pixel R, the green pixel G, the blue pixel B and the white pixel W, is described as an example, but the invention is not limited thereto.

It is to be explained that, in the embodiments of the invention, each odd-numbered column of each of the sub-pixel repeating units 112 is, for example, alternately arranged with the red pixels R and the blue pixels B. Particularly, in the embodiments of the invention, the extra sub-pixel is disposed at the edge of each of the sub-pixel repeating units 112 (e.g., at the last column of the sub-pixel repeating unit 112, namely, the last odd-numbered column, but the invention is not limited thereto), and thus the extra sub-pixel is also arranged in the odd-numbered column and may be the red pixel R or the blue pixel B.

Another worth mentioning is that, in the embodiments of the invention, one sub-pixel repeating unit 112 (the first sub-pixel repeating unit) on the display panel 110 is, for example, being arranged adjacent to another sub-pixel repeating unit 112 (the second sub-pixel repeating unit) by the last odd-numbered column thereof. As previously described, in the embodiments of the invention, since extra sub-pixels including two different colors (respectively referred to as a first sub-pixel and a second sub-pixel) can be disposed at the last odd-numbered column of the sub-pixel repeating unit 112, the first sub-pixel and the second sub-pixel are arranged adjacent to each other and alternately in the last odd-numbered column; and in terms of the first sub-pixel repeating unit, each odd-numbered row thereof is, for example, arranged adjacent to the second sub-pixel repeating unit by the first sub-pixel, and each even number row thereof is, for example, arranged adjacent to the second sub-pixel repeating unit by the second sub-pixel. Therefore, in one embodiment, if the first pixel unit in the first sub-pixel repeating unit is adjacent to the first sub-pixel, and the first pixel unit is written by one group of pixel data (referred to as a first group of pixel data) in the plurality of pixel data, then the first sub-pixel can be driven according to the first group of pixel data, so as to be color mixed with the first pixel unit. In addition, if the second pixel unit in the first sub-pixel repeating unit is adjacent to the second sub-pixel, and the second pixel unit is written by another group of pixel data (referred to as a second group of pixel data) in the plurality of pixel data, then the second sub-pixel can be driven according to the second group of pixel data, so as to be color mixed with the second pixel unit. As a result, the first sub-pixel repeating unit is able to use its own extra sub-pixels (i.e., the first and the second sub-pixels) to provide coloring resources.

Based on the above concept, several embodiments are provided below for describing in detail the possible implementations of the invention.

Figure 4A:
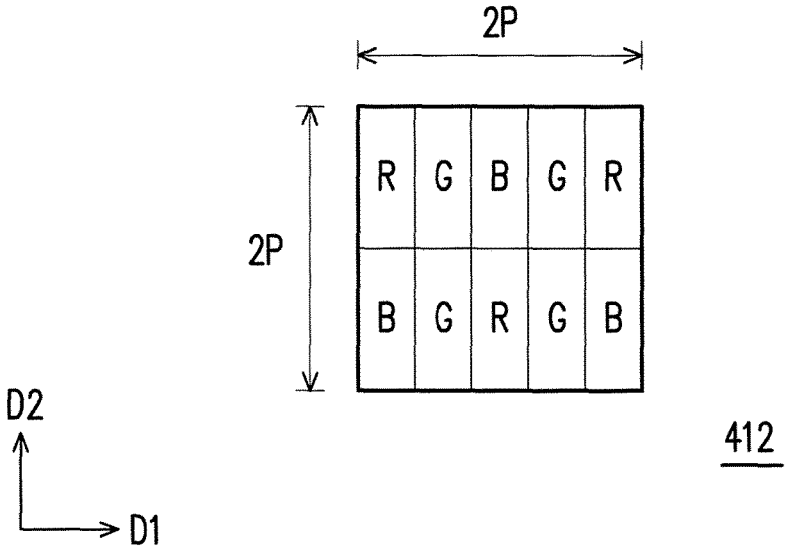
FIG. 4A is a schematic top view of a sub-pixel repeating unit illustrated according to one embodiment of the invention.
Figure 4B:
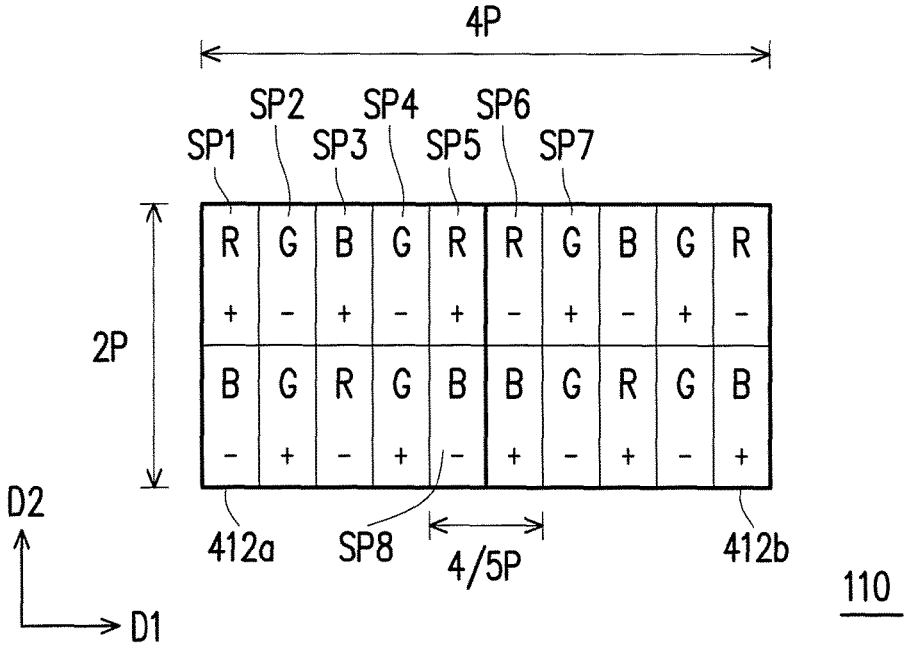
FIG. 4B is a schematic top view of a display panel illustrated according to one embodiment of the invention.
Figure 4C:
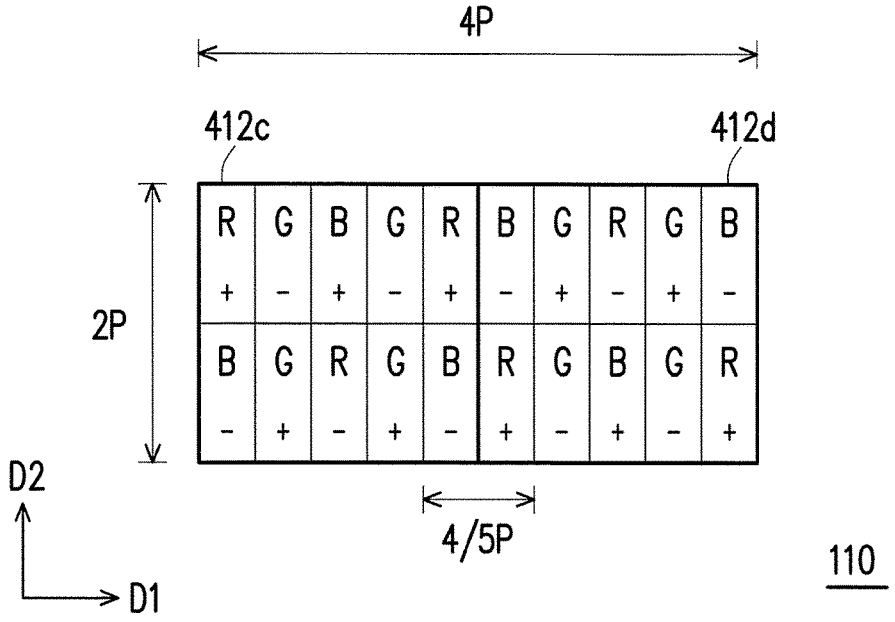
FIG. 4C is a schematic top view of a display panel illustrated according to one embodiment of the invention.

Firstly, using the embodiments of FIG. 4A to FIG. 4C to provide explanations. FIG. 4A is a schematic top view of a sub-pixel repeating unit illustrated according to one embodiment of the invention, FIG. 4B is a schematic top view of a display panel illustrated according to one embodiment of the invention, and FIG. 4C is a schematic top view of a display panel illustrated according to one embodiment of the invention. FIG. 4A illustrates one sub-pixel repeating unit 412; and for the convenience of explanation, FIG. 4B only illustrates an area on the display panel 110 includes two sub-pixel repeating units 412 (respectively represented by 412*a* and 412*b*), and FIG. 4C only illustrate an area on the display panel 110 that includes two sub-pixel repeating units 412 (respectively represented by 412*c* and 412*d*). Those skilled in the art should be able to understand that, the display panel 110 substantially includes an array constituted by a plurality of sub-pixel repeating units 412.

Referring to FIG. 4A, in the present embodiment, each row of the sub-pixel repeating unit 412 includes 5 sub-pixels. The 5 sub-pixels may be formed by arranging two of the pixel units shown in FIG. 3 with an extra sub-pixel, and may be written by 2 pixel data (i.e., the amount N of the pixel data equals 2). In other words, each pixel data in the present embodiment is substantially being written with 5/2 sub-pixels.

In detail, the sub-pixel repeating unit 412 are 10 sub-pixels that are arranged in a 5×2 array, which includes three red pixels R, four green pixels G and three blue pixels B. In the present embodiment, a length of the sub-pixel repeating unit 412 in the first direction D1 is, for example, 2P, and a length thereof in the second direction D2 is, for example, 2P.

As shown in FIG. 4A, in the first, third and fifth columns of the sub-pixel repeating unit 412, the red pixels R and the blue pixels B are alternately arranged, and in the second and fourth columns of the sub-pixel repeating unit 412, a striped arrangement is formed by the green pixels G. It is to be explained that, in the present embodiment, arrangements of the red pixels R and the blue pixels B in the first column and the fifth column are the same. Additionally, in other embodiments, the arrangements of the first column and the third column can be swapped; the invention is not limited thereto.

Specifically, referring to FIG. 4A, in the sub-pixel repeating unit 412, sequentially from left to right of the first row are the red pixel R, the green pixel G, the blue pixel B, the green pixel G, and the red pixel R; and sequentially from left to right of the second row are the blue pixel B, the green pixel G, the red pixel R, the green pixel G and the blue pixel B.

Next, using FIG. 4B and FIG. 4C to explain two arrangements that are capable of being formed by the sub-pixel repeating units 412 on the display panel 110.

Referring to FIG. 4B, the display panel 110 includes the sub-pixel repeating unit 412*a* and the sub-pixel repeating unit 412*b*, and the sub-pixel repeating unit 412*a* and the sub-pixel repeating unit 412*b* are arranged adjacent to each other along the row direction (i.e., the first direction D1).

The combination constituted by the sub-pixel repeating unit 412*a* and the sub-pixel repeating unit 412*b* may be arranged repeatedly on the display panel 110 to form a pixel array of the present embodiment. A length of the said combination in the first direction D1 is, for example, 4P, and a length thereof in the second direction D2 is, for example, 2P. It is worth mentioning that, in the present embodiment, an arrangement of the sub-pixels in the sub-pixel repeating units 412*a* and 412*b* is the same as that of the sub-pixels in the sub-pixel repeating unit 412 of FIG. 4A. In other words, in the present embodiment, the red pixel R (sub-pixel SP5) and the blue pixel B (sub-pixel SP8) included by the last odd-numbered column of the sub-pixel repeating unit 412*a* are, namely, the extra sub-pixels, and sub-pixels SP5 and SP8 are adjacent to each other so as to be staggeredly arranged in the last odd-numbered column of the sub-pixel repeating unit 412*a*.

Specifically, in the present embodiment, the last odd-numbered column of the sub-pixel repeating unit 412*a* may be arranged adjacent to the sub-pixel repeating unit 412*b*. Each odd-numbered row of the sub-pixel repeating unit 412*a* may be adjacent to the sub-pixel repeating unit 412*b* by the sub-pixel SP5, and each even-numbered row of the sub-pixel repeating unit 412*a* may be adjacent to the sub-pixel repeating unit 412*b* by the sub-pixel SP8.

Using the first row of the sub-pixel repeating unit 412*a* as an example, how the sub-pixel repeating unit 412*a* uses its own sub-pixels to provide color borrowing resources is further explained. The sub-pixels SP1 and SP2 constitute one pixel unit, the sub-pixels SP3 and SP4 constitute another pixel unit, and the sub-pixel SP5 is configured to provide the extra sub-pixel for color borrowing. In other words, the first row of the sub-pixel repeating unit 412*a* is adjacent to the sub-pixel repeating unit 412*b* by the sub-pixel SP5. If the controller 130 intends to write the pixel data that includes red color into the pixel unit constituted by the sub-pixels SP3 and SP4, since the sub-pixels SP3 and SP4 (respectively being the blue pixel B and the green pixel G) of the present embodiment are merely configured to display blue color and green color, the controller 130, after being calculated by an algorithm of sub-pixel rendering, may determine to drive the sub-pixel SP5 by the driver 120, thereby enabling the sub-pixel repeating unit 412*a* to directly display red color with its own sub-pixel SP5, so as to perform color mixing with the sub-pixels SP3 and SP4. As a result, it is not necessary to borrow color from the sub-pixel (e.g., the sub-pixel SP6 in the sub-pixel repeating unit 412*b*) in other adjacent sub-pixel repeating unit. Similarly, the driver 120 may also drive the sub-pixel SP8 according to the pixel data being written into the pixel unit adjacent to the sub-pixel SP8 in the sub-pixel repeating unit 412*a*, so as to use the sub-pixel SP8 to perform color mixing with the pixel unit adjacent thereto.

FIG. 4C illustrates another arrangement of the sub-pixel repeating units 412 on the display panel 110, wherein the display panel 110 includes the sub-pixel repeating unit 412*c* and the sub-pixel repeating unit 412*d*, and the sub-pixel repeating unit 412*c* and the sub-pixel repeating unit 412*d* are arranged adjacent to each other along the row direction (i.e., the first direction D1). The present embodiment is similar to the previous embodiment shown in FIG. 4B, and thus descriptions regarding the similar contents will not be repeated. A difference between the two lies in that, in the present embodiment, odd-numbered rows and even-numbered rows in the sub-pixel repeating unit 412*d* are staggeredly arranged with odd-numbered rows and even-numbered rows in the sub-pixel repeating unit 412*c*. More specifically, in the sub-pixel repeating unit 412*d*, an arrangement of the sub-pixels in the odd-numbered rows is the same as an arrangement of the sub-pixels in the even-numbered rows of the sub-pixel repeating unit 412*c*, and an arrangement of the sub-pixels in the even-numbered rows of the sub-pixel repeating unit 412*d* is the same as an arrangement of the sub-pixels in the odd-numbered rows of the sub-pixel repeating unit 412*c*. In simple terms, the sub-pixel repeating unit 412*d* may be considered as a mirror arrangement of the sub-pixel repeating unit 412*c*, and the sub-pixel repeating unit 412*d* is, for example, an arrangement pattern of placing each sub-pixel in the sub-pixel repeating unit 412*c* up-side down.

Hence, with the design of adding the sub-pixel SP5 into the sub-pixel repeating unit 412, when the pixel data corresponding to the sub-pixel repeating unit 412 is being written therein, the sub-pixel repeating unit 412 can use its own sub-pixels to provide the color mixing in each pixel unit.

Particularly, in the present embodiment, since there is an odd number of sub-pixels in each row of the sub-pixel repeating unit 412, the sub-pixels of a same color on the display panel 110 can further be adjusted to have different polarities (as shown in FIG. 4B and FIG. 4C, wherein 『+』 indicates positive polarity and 『−』 indicates negative polarity). As a result, the problem of display screen flickering caused by the same colored sub-pixels having same polarity can be improved.

Another worth mentioning is that, as shown in the embodiment of FIG. 4B, a largest slit gap SG between two adjacent green pixels G (e.g., the sub-pixel SP4 in the sub-pixel repeating unit 412*a* and the sub-pixel SP7 in the sub-pixel repeating unit 412*b*) in the first direction D1 is 4/5 P. Similarly, a largest slit gap SG in the embodiment of FIG. 4C is also 4/5 P. As previously described, the pitch P of the display panel 110 is related to the resolution, and thus the slit gap SG can also determine an applicable resolution for the display panel 110 of the present embodiment. For instance, if a design requirement of the slit gap SG is to be less than 42 um, then the resolution of the display panel 110 would correspondingly be designed as higher than 400 PPI. In other words, under the arrangement of the sub-pixels of the present embodiment, the display apparatus 100 can be applied in a high resolution design, and can attain a favorable image visual resolution.

Embodiments of FIG. 5A to FIG. 5C and FIG. 6A to FIG. 6B are further provided in the following to explain the cases when N equals to 2, wherein N is the amount of pixel data being written into one row of the sub-pixel repeating unit. In other words, in the embodiments of FIG. 5A to FIG. 6B, each pixel data is also substantially being written with 5/2 sub-pixels.

Figure 5A:
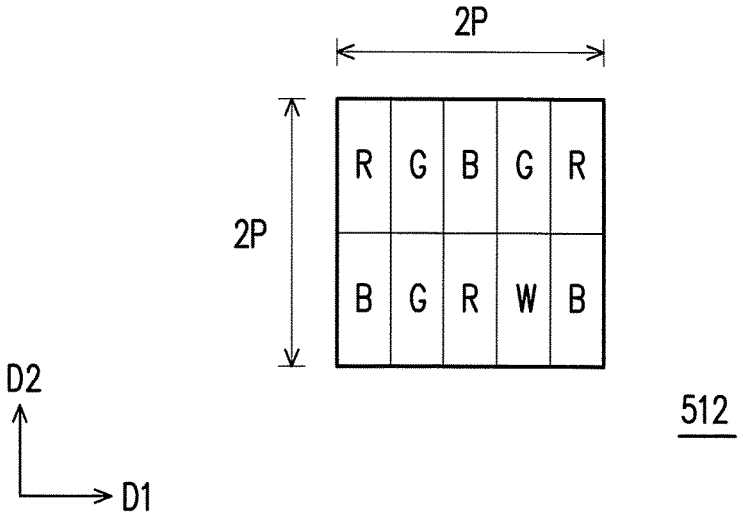
FIG. 5A is a schematic top view of a sub-pixel repeating unit illustrated according to one embodiment of the invention.
Figure 5B:
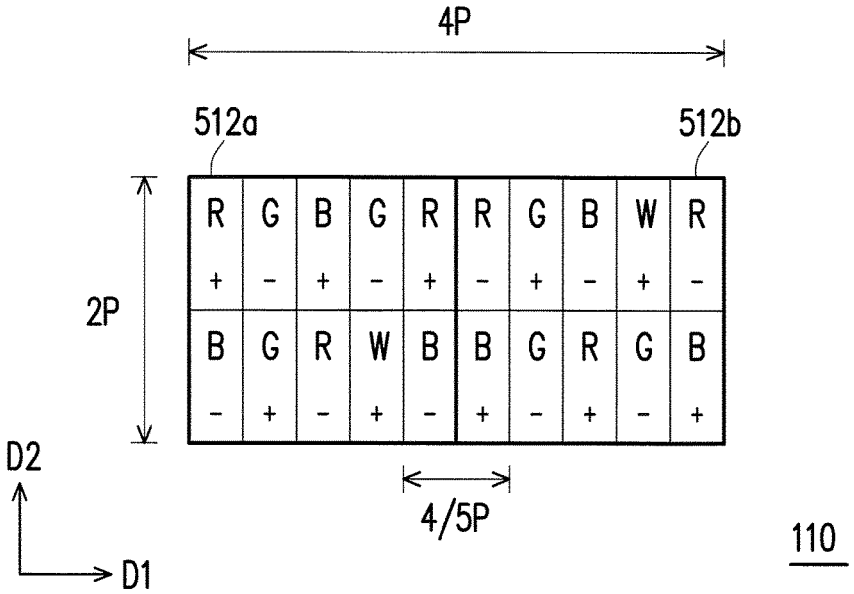
FIG. 5B is a schematic top view of a display panel illustrated according to one embodiment of the invention.
Figure 5C:
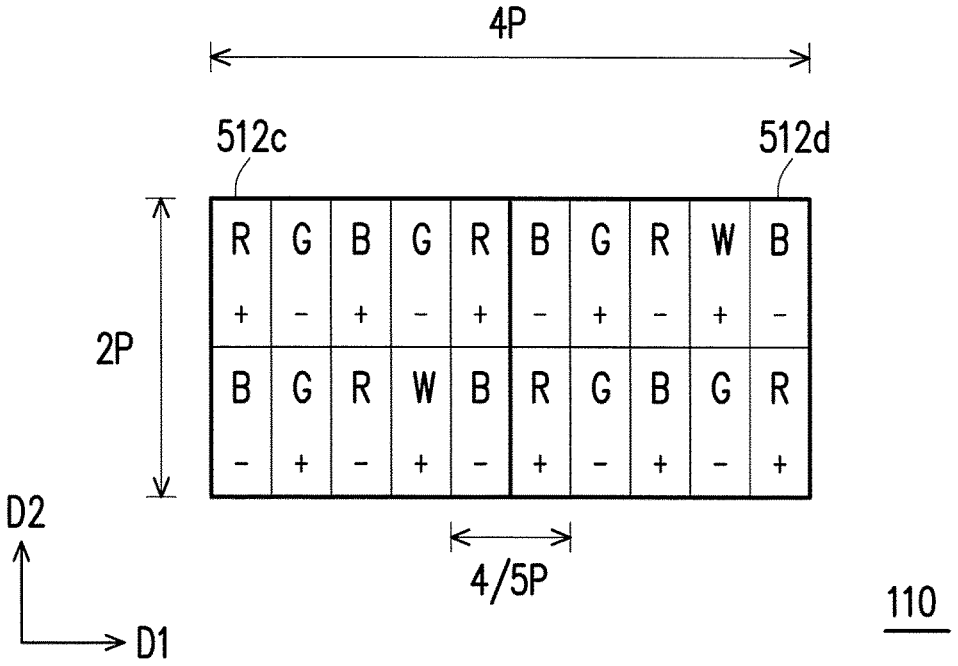
FIG. 5C is a schematic top view of a display panel illustrated according to one embodiment of the invention.

The embodiments of FIG. 5A to FIG. 5C are described hereinafter. FIG. 5A is a schematic top view of a sub-pixel repeating unit illustrated according to one embodiment of the invention, FIG. 5B is a schematic top view of a display panel illustrated according to one embodiment of the invention, and FIG. 5C is a schematic top view of a display panel illustrated according to one embodiment of the invention. FIG. 5A illustrates one sub-pixel repeating unit 512; and for the convenience of explanation, FIG. 5B only illustrates an area on the display panel 110 that includes two sub-pixel repeating units 512 (respectively represented by 512*a* and 512*b*), and FIG. 5C only illustrates an area on the display panel 110 that includes two sub-pixel repeating units 512 (respectively represented by 512*c* and 512*d*). Those skilled in the art should be able to understand that, the display panel 110 substantially includes an array constituted by a plurality of sub-pixel repeating units 512.

Referring to FIG. 5A, the sub-pixel repeating unit 512 is 10 sub-pixels that are being arranged in a 5×2 array, which includes three red pixels R, three green pixels G, three blue pixels B and one white pixel W. The sub-pixel repeating unit 512 of the present embodiment is similar to the sub-pixel repeating unit 412 in the embodiment of FIG. 4, and a difference therebetween merely lies in that the pixel repeating unit 512 replaces one of the green pixels G in the embodiment of FIG. 4 with the white pixel W; whereas, other similar parts may be referred back to the previous descriptions, and thus will not be repeated herein. It is worth mentioning that, with the arrangement provided in the present embodiment, a spatial frequency of the white pixels W and the green pixels G in the fourth column of the sub-pixel repeating unit 512 can be 1:1.

Next, using FIG. 5B and FIG. 5C to explain two arrangements that are capable of being formed by the sub-pixel repeating units 512 on the display panel 110.

Referring to FIG. 5B, the display panel 110 includes the sub-pixel repeating unit 512*a* and the sub-pixel repeating unit 512*b* thereon, and the sub-pixel repeating unit 512*a* and the sub-pixel repeating unit 512*b* are arranged adjacent to each other along the row direction (i.e., the first direction D1). Similarly, the combination constituted by the sub-pixel repeating unit 512*a* and the sub-pixel repeating unit 512*b* may be arranged repeatedly on the display panel 110 so as to form the pixel array of the present embodiment. A length of the said combination in the first direction D1 is, for example, 4P, and a length thereof in the second direction D2 is, for example, 2P. Particularly, in the present embodiment, the sub-pixels of the sub-pixel repeating unit 512*a* are arranged in the same manner as the sub-pixels of the sub-pixel repeating unit 512 in FIG. 5A, while the arrangement of the sub-pixels of the sub-pixel repeating unit 512*b* is to swap the white pixel W with the green pixel G in the fourth column of the sub-pixel repeating unit 512.

FIG. 5C illustrates another arrangement of the sub-pixel repeating units 512 on the display panel 110. The display panel 110 includes the sub-pixel repeating unit 512*c* and the sub-pixel repeating unit 512*d* thereon, and the sub-pixel repeating unit 512*c* and the sub-pixel repeating unit 512*d* are arranged adjacent to each other along the row direction (i.e., the first direction D1). The present embodiment is similar to the previous embodiment of FIG. 5B, and thus similar parts will not be repeated herein. A difference between the two lies in that, odd-numbered rows and even-numbered rows in the sub-pixel repeating unit 512*d* of the present embodiment are staggeredly arranged with odd-numbered rows and even-numbered rows in the sub-pixel repeating unit 512*c*. In simple terms, the sub-pixel repeating unit 512*d* may be considered as a mirror arrangement of the sub-pixel repeating unit 512*c*, and the sub-pixel repeating unit 512*d* is, for example, an arrangement pattern of placing each sub-pixel in the sub-pixel repeating unit 512*c* up-side down.

Particularly, as shown in the embodiment of FIG. 5B, a largest slit gap SG between two adjacent green pixels G (e.g., the green pixel G in the first row of the fourth column of the sub-pixel repeating unit 512*a* and the green pixel G in the first row of the second column of the sub-pixel repeating unit 512*b*) in the first direction D1 is 4/5 P. Similarly, a largest slit gap SG in the embodiment of FIG. 5C is also 4/5 P. As previously described, if the design requirement of the slit gap SG is to be less than 42 um, then the resolution of the display panel 110 would correspondingly be designed as higher than 400 PPI.

On the other hand, the distribution of the white pixel W on the display panel 110 can also affect the resolution of the display panel 110. In the present embodiment, if the combination of the sub-pixel repeating units 512*a* and 512*b* are arranged repeatedly on the display panel 110 according to FIG. 5B, then under this arrangement, four adjacent white pixels W on the display panel 110 may surround into a kite-shape with an aperture slot area SA being $4P^2$ (diagonal lengths thereof in the first direction D1 and the second direction D2 are respectively 4P and 2P, and these lengths are respectively calculated through a center of each sub-pixel). Similarly, the embodiment of FIG. 5C may also be surrounded into a kite-shape having the same area. If a design requirement of the aperture slot area SA is to be less than 14112 $um^2$, then the resolution of the display panel 110 would be correspondingly be designed as higher than 400 PPI.

Figure 6A:
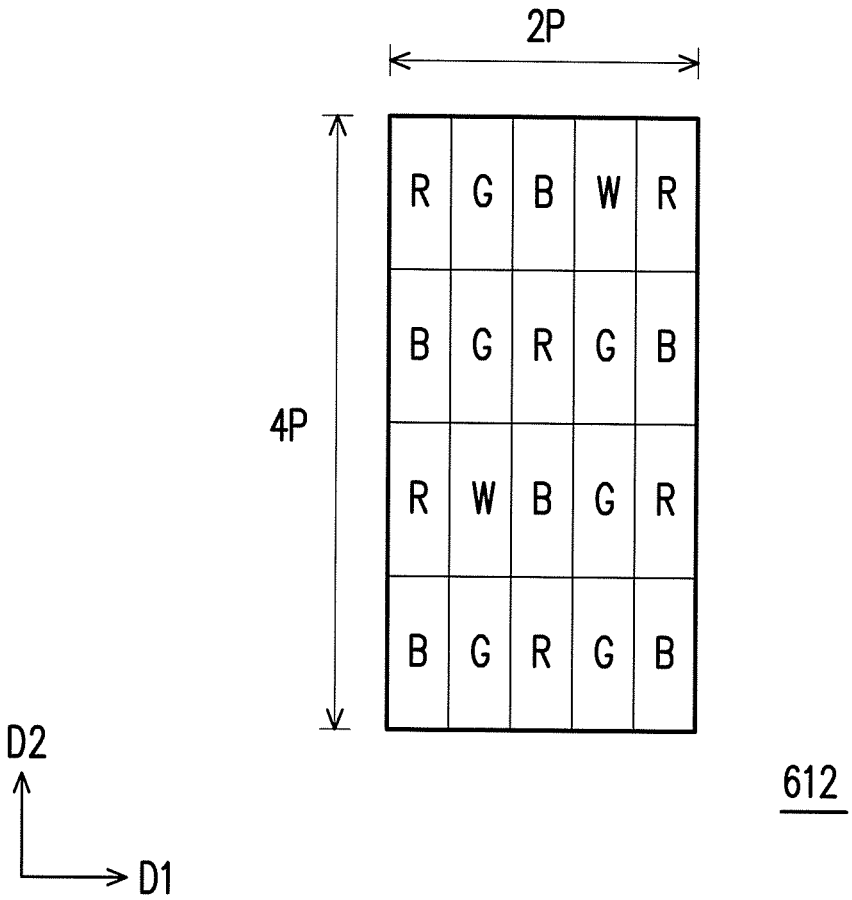
FIG. 6A is a schematic top view of a sub-pixel repeating unit illustrated according to one embodiment of the invention.
Figure 6B:
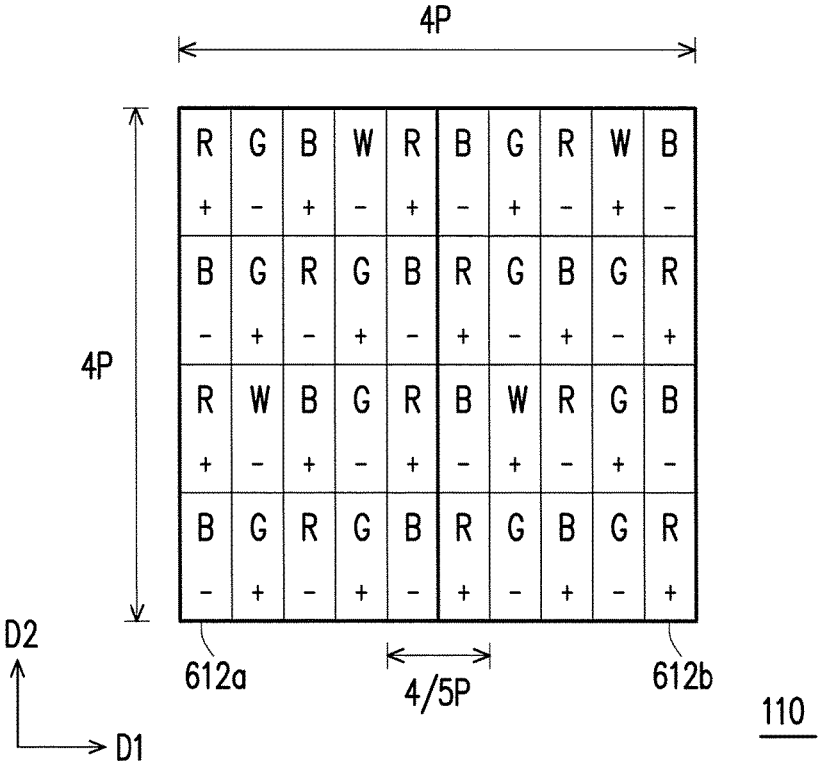
FIG. 6B is a schematic top view of a display panel illustrated according to one embodiment of the invention.

FIG. 6A to FIG. 6B illustrate another embodiment of the sub-pixel repeating units. FIG. 6A is a schematic top view of a sub-pixel repeating unit illustrated according to one embodiment of the invention, and FIG. 6B is a schematic top view of a display panel illustrated according to one embodiment of the invention. FIG. 6A illustrates one sub-pixel repeating unit 612; for the convenience of explanation, FIG. 6B only illustrates an area on the display panel 110 that includes two sub-pixel repeating units 612 (respectively represented by 612*a* and 612*b*). Those skilled in the art should be able to understand that, the display panel 110 substantially includes an array constituted by a plurality of sub-pixel repeating units 612.

Referring to FIG. 6A, the sub-pixel repeating unit 612 is 20 sub-pixels that are arranged in a 5×4 array, which includes six red pixels R, six green pixels G, six blue pixels B and two white pixels W. In the present embodiment, a length of the sub-pixel repeating unit 612 in the first direction D1 is, for example, 2P, and a length thereof in the second direction D2 is, for example, 4P.

As shown in FIG. 6A, the first, third and fifth columns of the sub-pixel repeating unit 612 are alternately arranged with the red pixels R and blue pixels B, and the second and fourth columns of the sub-pixel repeating unit 612 are arranged with the white pixels W and the green pixels G with a spatial frequency of 1:3. It is to be explained that, in the present embodiment, the arrangement of the red pixels R and the blue pixels B in the first column is the same as in the fifth column. Moreover, in other embodiments, the arrangements of the first column and the third column can be exchanged; the invention is not limited thereto.

Specifically, referring to FIG. 6A, in the sub-pixel repeating unit 612, sequentially from left to right of the first row are the red pixel R, the green pixel G, the blue pixel B, the white pixel W, and the red pixel R; sequentially from left to right of the second row are the blue pixel B, the green pixel G, the red pixel R, the green pixel G, and the blue pixel B; sequentially from left to right of the third row are the red pixel R, the white pixel W, the blue pixel B, the green pixel G, and the red pixel R; and sequentially from left to right of the fourth row are the blue pixel B, the green pixel G, the red pixel R, the green pixel G, and the blue pixel B.

Next, using FIG. 6B to explain an arrangement that is capable of being formed by the sub-pixel repeating units 612 on the display panel 110.

Referring to FIG. 6B, the display panel 110 includes the sub-pixel repeating unit 612*a* and the sub-pixel repeating unit 612*b* thereon, and the sub-pixel repeating unit 612*a* and the sub-pixel repeating unit 612*b* are arranged adjacent to each other along the row direction (i.e., the first direction D1). The combination constituted by the sub-pixel repeating unit 612*a* and the sub-pixel repeating unit 612*b* may be arranged repeatedly on the display panel 110 to form the pixel array of the present embodiment. A length of the said combination in the first direction D1 is, for example, 4P, and a length thereof in the second direction D2 is, for example, 4P. It is to be noted that, in the present embodiment, the sub-pixels of the sub-pixel repeating unit 612*a* are arranged in a same manner as the sub-pixels of the sub-pixel repeating unit 612 of FIG. 6A; while the arrangement of the sub-pixels of the sub-pixel repeating unit 612*b* is to swap the red pixels R with the blue pixels B in the first, third and fifth columns of the sub-pixel repeating unit 612.

Similar to the previously embodiment, in the embodiment of FIG. 6B, a larges slit gap SG between two adjacent green pixels G (e.g., the green pixel G in the second row of the fourth column of the sub-pixel repeating unit 612*a* and the green pixel G in the second row of the second column of the sub-pixel repeating unit 612*b*) in the first direction D1 is 4/5 P. Therefore, as previously described, if the design requirement of the slit gap SG is to be less than 42 um, then the resolution of the display panel 110 must be higher than 400 PPI.

Moreover, in the present embodiment, if the sub-pixel repeating units 612*a* and 612*b* are arranged repeatedly on the display panel 110 according to FIG. 6B, then under such arrangement, four adjacent white pixels W on the display panel 110 may surround into a kite-shape with an aperture slot area SA being $4P^2$ (diagonal lengths thereof in the first direction D1 and the second direction D2 are respectively 2P and 4P). If a design requirement of the aperture slot area SA is to be less than 14112 $um^2$, then the resolution of the display panel 110 would correspondingly be designed as higher than 400 PPI.

Embodiments of FIG. 7A to FIG. 7C, FIG. 8A to FIG. 8C, FIG. 9A to FIG. 9C and FIG. 10A to FIG. 10B are the embodiments when N equals 3, wherein N is the amount of pixel data being written into one row of the sub-pixel repeating unit. In other words, in the embodiments of FIG. 7A to FIG. 10B, each pixel data is substantially being written with 7/3 sub-pixels.

Figure 7A:
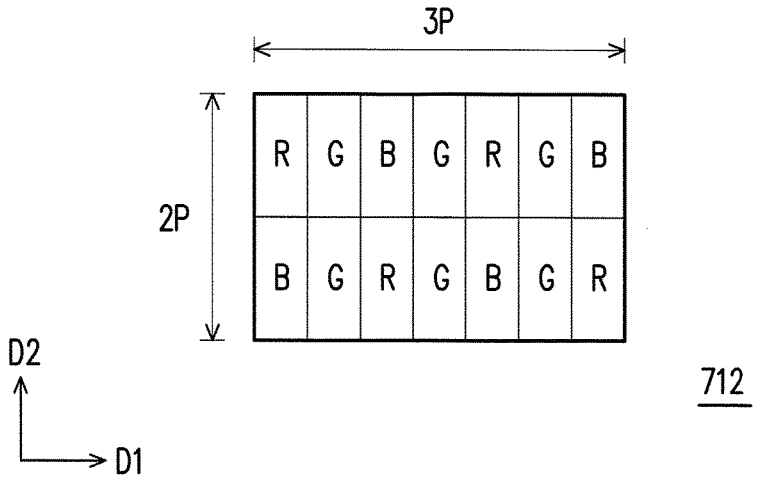
FIG. 7A is a schematic top view of a sub-pixel repeating unit illustrated according to one embodiment of the invention.
Figure 7B:
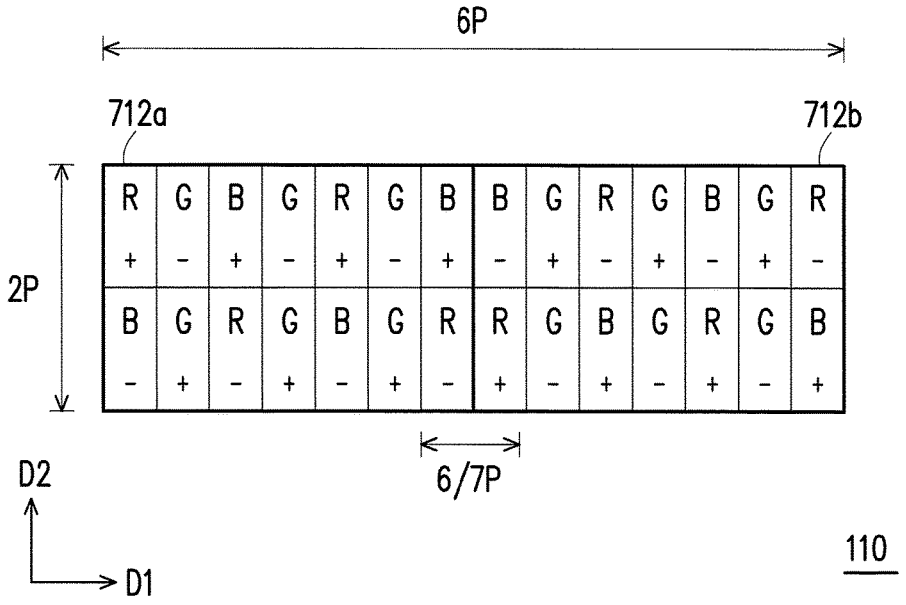
FIG. 7B is a schematic top view of a display panel illustrated according to one embodiment of the invention.
Figure 7C:
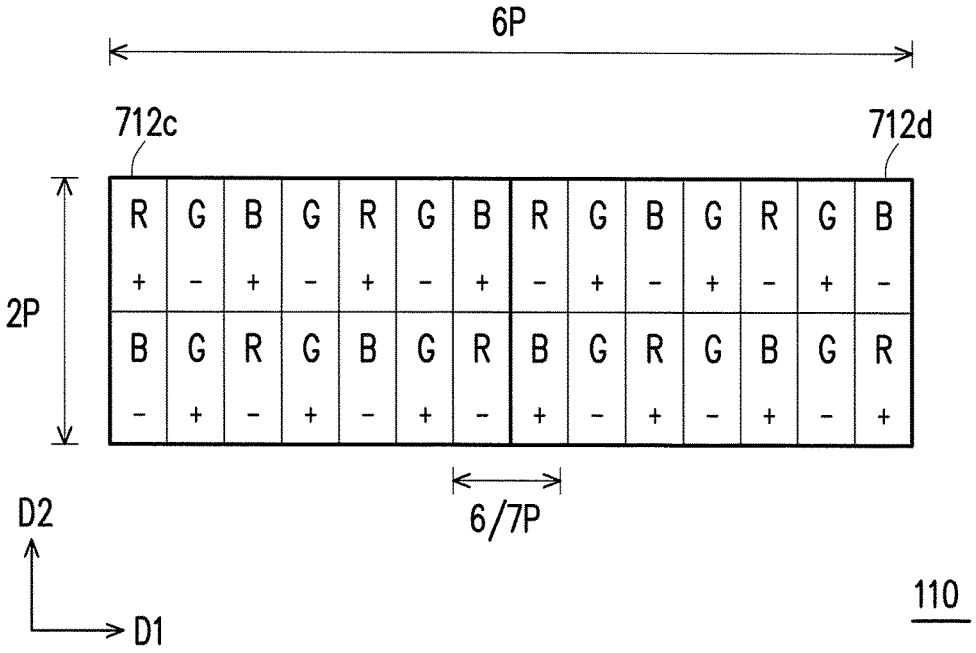
FIG. 7C is a schematic top view of a display panel illustrated according to one embodiment of the invention.

Using the embodiments of FIG. 7A to FIG. 7C to provide explanations. FIG. 7A is a schematic top view of a sub-pixel repeating unit illustrated according to one embodiment of the invention, FIG. 7B is a schematic top view of a display panel illustrated according to one embodiment of the invention, and FIG. 7C is a schematic top view of a display panel illustrated according to one embodiment of the invention. FIG. 7A illustrates one sub-pixel repeating unit 712; and for the convenience of explanation, FIG. 7B only illustrates an area on the display panel 110 that includes two sub-pixel repeating units 712 (respectively represented by 712*a* and 712*b*), and FIG. 7C only illustrates an area on the display panel 110 that includes two sub-pixel repeating units 712 (respectively represented by 712*c* and 712*d*). Those skilled in the art should be able to understand that, the display panel 110 substantially includes an array constituted by a plurality of sub-pixel repeating units 712.

Referring to FIG. 7A, the sub-pixel repeating unit 712 is 14 sub-pixels that are arranged into a 7×2 array, which includes four pixels R, six green pixels G and four blue pixels B. In the present embodiment, a length of the sub-pixel repeating unit 712 in the first direction D1 is, for example, 3P, and a length thereof in the second direction D2 is, for example, 2P.

As shown in FIG. 7A, in the first, third, fifth and seventh columns of the sub-pixel repeating unit 712, the red pixels R and the blue pixels B are alternately arranged; and in the second, fourth and sixth columns of the sub-pixel repeating unit 712, a striped arrangement is formed by the green pixels G.

Specifically, referring to FIG. 7A, in the sub-pixel repeating unit 712, sequentially from left to right of the first row are the red pixel R, the green pixel G, the blue pixel B, the green pixel G, the red pixel R, the green pixel G, and the blue pixel B; sequentially from left to right of the second row are the blue pixel B, the green pixel G, the red pixel R, the green pixel G, the blue pixel B, the green pixel G, and the red pixel R.

Next, using FIG. 7B and FIG. 7C to explain two arrangements that are capable of being formed by the sub-pixel repeating units 712 on the display panel 110.

Referring to FIG. 7B, the display panel 110 includes the sub-pixel repeating unit 712*a* and the sub-pixel repeating unit 712*b* thereon, and the sub-pixel repeating unit 712*a* and the sub-pixel repeating unit 712*b* are arranged adjacent to each other along the row direction (i.e., the first direction D1). The combination constituted by the sub-pixel repeating unit 712*a* and the sub-pixel repeating unit 712*b* may be arranged repeatedly on the display panel 110 to form the pixel array of the present embodiment. A length of the said combination in the first direction D1 is, for example, 6P, and a length thereof in the second direction D2 is, for example 2P. It is worth mentioning that, in the present embodiment, odd-numbered rows and even-numbered rows in the sub-pixel repeating unit 712*b* are staggeredly arranged with odd-numbered rows and even-numbered rows in the sub-pixel repeating unit 712*a*. In simple terms, the sub-pixel repeating unit 712*b* may be considered as a mirror arrangement of the sub-pixel repeating unit 712*a*, and the sub-pixel repeating unit 712*b* is, for example, an arrangement pattern of placing each sub-pixel in the sub-pixel repeating unit 712*a* up-side down. In addition, from another point of view, the sub-pixel repeating unit 712*b* of the present embodiment may also be considered as an arrangement pattern of placing each sub-pixel in the sub-pixel repeating unit 712*a* left-and-right reversed.

FIG. 7C illustrates another arrangement of the sub-pixel repeating units 712 on the display panel 110. The display panel 110 includes the sub-pixel repeating unit 712*c* and the sub-pixel repeating unit 712*d* thereon, and the sub-pixel repeating unit 712*c* and the sub-pixel repeating unit 712*d* are arranged adjacent to each other along the row direction (i.e., the first direction D1). The present embodiment is similar to the previous embodiment, and thus similar parts will not be repeated herein. A difference between the two lies in that, the arrangement of the sub-pixels of the sub-pixel repeating units 712*c* and 712*d* of the present embodiment is the same as that of the sub-pixels of the sub-pixel repeating unit 712 of FIG. 7.

Another worth mentioning is that, in the embodiment of FIG. 7B, a largest slit gap SG between two adjacent green pixels G (e.g., the green pixel G in the first row of the sixth column of the sub-pixel repeating unit 712*a* and the green pixel G in the first row of the second column of the sub-pixel repeating unit 712*b*) in the first direction D1 is 6/7 P. Similarly, a largest slit gap SG in the embodiment of FIG. 7C is also 6/7 P. Therefore, if a design requirement of the slit gap SG is to be less than 42 um, then the resolution of the display panel 110 would correspondingly be designed as higher than 500 PPI.

Figure 8A:
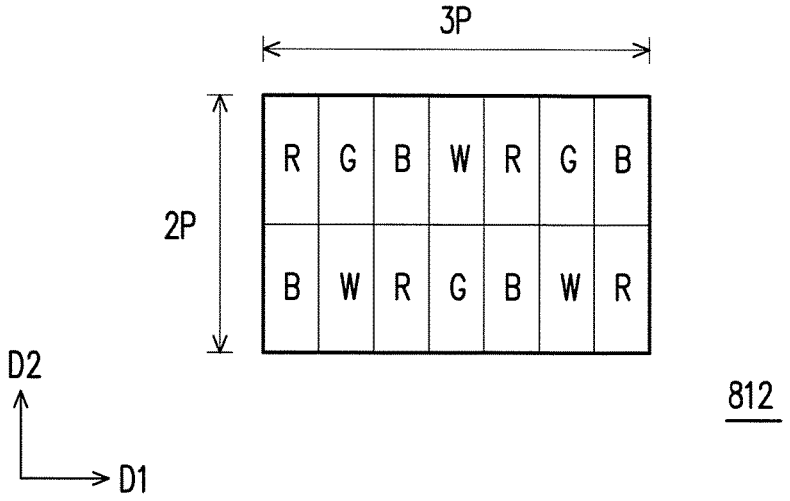
FIG. 8A is a schematic top view of a sub-pixel repeating unit illustrated according to one embodiment of the invention.
Figure 8B:
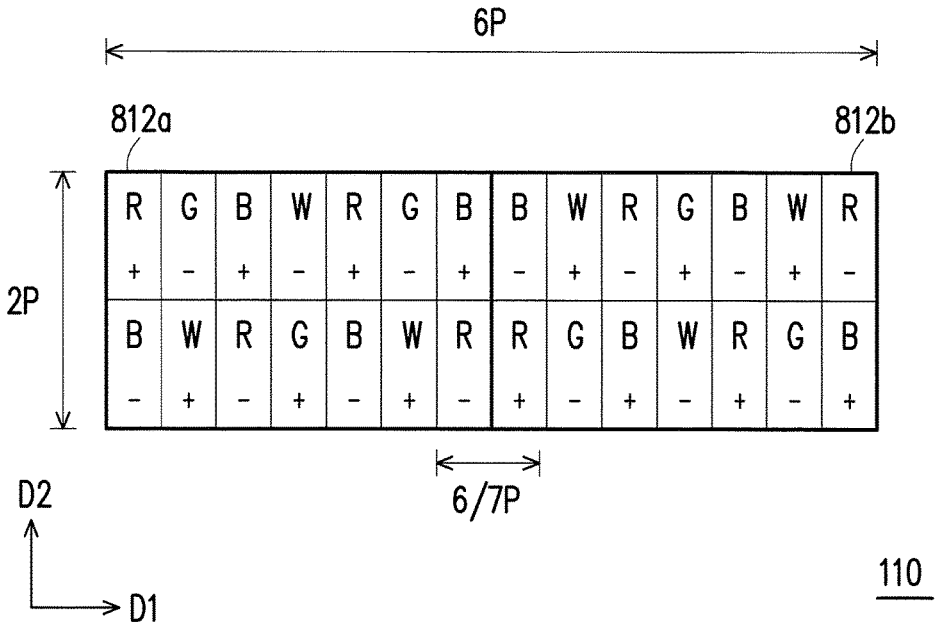
FIG. 8B is a schematic top view of a display panel illustrated according to one embodiment of the invention.
Figure 8C:
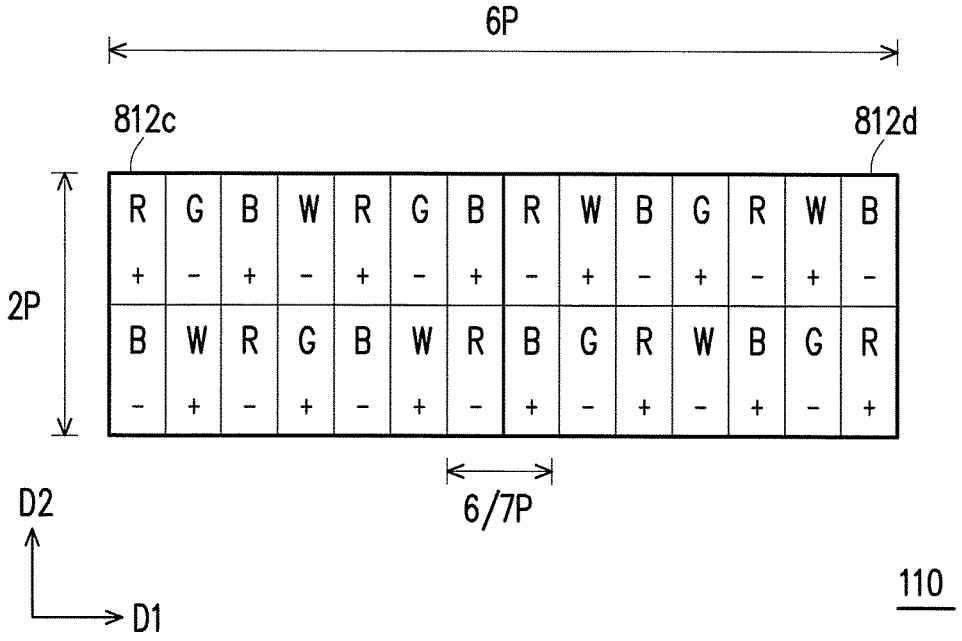
FIG. 8C is a schematic top view of a display panel illustrated according to one embodiment of the invention.

FIG. 8A to FIG. 8C illustrate another embodiment of the sub-pixel repeating units. FIG. 8A is a schematic top view of a sub-pixel repeating unit illustrated according to one embodiment of the invention, FIG. 8B is a schematic top view of a display panel illustrated according to one embodiment of the invention, and FIG. 8C is a schematic top view of a display panel illustrated according to one embodiment of the invention. FIG. 8A illustrates one sub-pixel repeating unit 812; and for the convenience of explanation, FIG. 8B only illustrates an area on the display panel 110 that includes two sub-pixel repeating units 812 (respectively represented by 812*a* and 812*b*), and FIG. 8C only illustrates an area on the display panel 110 that includes two sub-pixel repeating units 812 (respectively represented by 812*c* and 812*d*). Those skilled in the art should be able to understand that, the display panel 110 substantially includes an array constituted by a plurality of sub-pixel repeating units 812.

Referring to FIG. 8A, the sub-pixel repeating unit 812 is 14 sub-pixels that are arranged into a 7×2 array, which includes four red pixels R, three green pixels G, four blue pixels B and three white pixels W. The sub-pixel repeating unit 812 of the present embodiment is similar to the sub-pixel repeating unit 712 of the embodiment of FIG. 7, and differences between the two merely lie in that, the sub-pixel repeating unit 812 of the present embodiment replaces three of the green pixels G in the embodiment of FIG. 7 with the white pixels W, and enables the green pixels G and the white pixels W in the even-numbered columns of the sub-pixel repeating unit 812 to be alternately arranged, so as to enable the adjacent green pixels G on the display panel 110 to form a checkerboard arrangement and to enable the adjacent white pixels W on the display panel 110 to form a checkerboard arrangement. Other similar parts may be referred to the previous descriptions, and thus will not be repeated herein. It is worth mentioning that, with the arrangement provided in the present embodiment, a spatial frequency of the white pixels W and the green pixels G in the second, fourth and sixth columns of the sub-pixel repeating unit 812 can be 1:1.

Next, using FIG. 8B and FIG. 8C to explain two arrangements that are capable of being formed by the sub-pixel repeating units 812 on the display panel 110.

Referring to FIG. 8B, the display panel 110 includes the sub-pixel repeating unit 812*a* and the sub-pixel repeating unit 812*b* thereon, and the sub-pixel repeating unit 812*a* and the sub-pixel repeating unit 812*b* are arranged adjacent to each other along the row direction (i.e., the first direction D1). Similarly, the combination constituted by the sub-pixel repeating unit 812*a* and the sub-pixel repeating unit 812*b* may be arranged repeatedly on the display panel 110 to form the pixel array of the present embodiment, and a length of the said combination in the first direction D1 is, for example, 6P, and a length thereof in the second direction D2 is, for example, 2P. Particularly, in the present embodiment, odd-numbered rows and even-numbered rows in the sub-pixel repeating unit 812*b* are staggeredly arranged with odd-numbered rows and even-numbered rows in the sub-pixel repeating unit 812*a*. In simple terms, the sub-pixel repeating unit 812*b* may be considered as a mirror arrangement of the sub-pixel repeating unit 812*a*, and the sub-pixel repeating unit 812*b* is, for example, an arrangement pattern of placing each sub-pixel in the sub-pixel repeating unit 812*a* up-side down.

FIG. 8C illustrates another arrangement of the sub-pixel repeating units 812 on the display panel 110. The display panel 110 includes the sub-pixel repeating unit 812*c* and the sub-pixel repeating unit 812*d* thereon, and the sub-pixel repeating unit 812*c* and the sub-pixel repeating unit 812*d* are arranged adjacent to each other along the row direction (i.e., the first direction D1). The present embodiment is similar to the previous embodiment of FIG. 8B, and thus similar parts will not be repeated herein. A difference between the two lies in that, in the present embodiment, the sub-pixels of the sub-pixel repeating unit 812*a* are arranged in a same manner as the sub-pixels of the sub-pixel repeating unit 812 of FIG. 8A, while the arrangement of the sub-pixels of the sub-pixel repeating unit 812*b* is to swap the white pixels W with the green pixels G in the second, fourth and sixth columns of the sub-pixel repeating unit 812.

Another worth mentioning is that, in the embodiment of FIG. 8B, a largest slit gap SG between two adjacent green pixels G (e.g., the green pixel G in the first row of the sixth column of the sub-pixel repeating unit 812*a* and the green pixel G in the second row of the second column of the sub-pixel repeating unit 812*b*) in the first direction D1 is 6/7 P. Similarly, a largest slit gap SG in the embodiment of FIG. 8C is also 6/7 P. As previously described, if the design requirement of the slit gap SG is to be less than 42 um, then the resolution of the display panel 110 must be higher than 500 PPI.

Moreover, in the present embodiment, if the combination of the sub-pixel repeating units 812*a* and 812*b* are arranged repeatedly on the display panel 110 according to FIG. 8B, then four adjacent white pixels W on the display panel 110 may surround into a kite-shape with a largest aperture slot area SA being 12/7 $P^2$ (diagonal lengths thereof in the first direction D1 and the second direction D2 are respectively 12/7 P and 2P). Similarly, the embodiment of FIG. 8C may also be surrounded into a kite-shape having the same area. Therefore, if the design requirement of the aperture slot area SA is to be less than 14112 $um^2$, then the resolution of the display panel 110 would be correspondingly be designed as higher than 303 PPI.

Figure 9A:
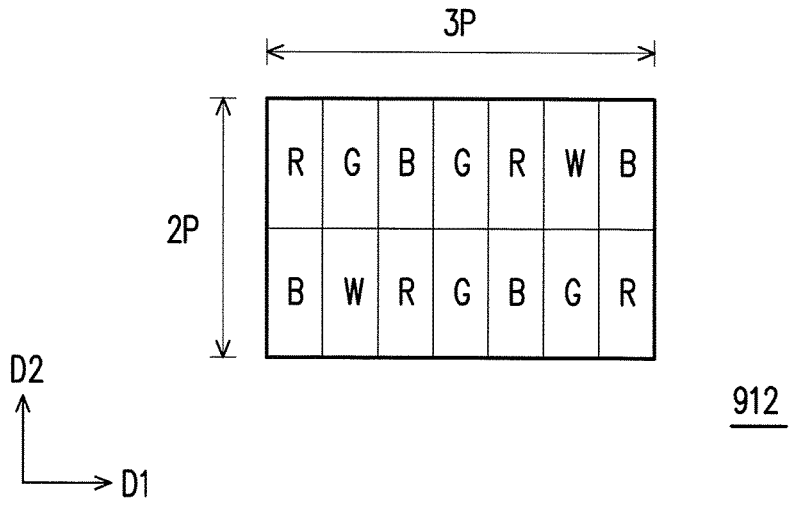
FIG. 9A is a schematic top view of a sub-pixel repeating unit illustrated according to one embodiment of the invention.
Figure 9B:
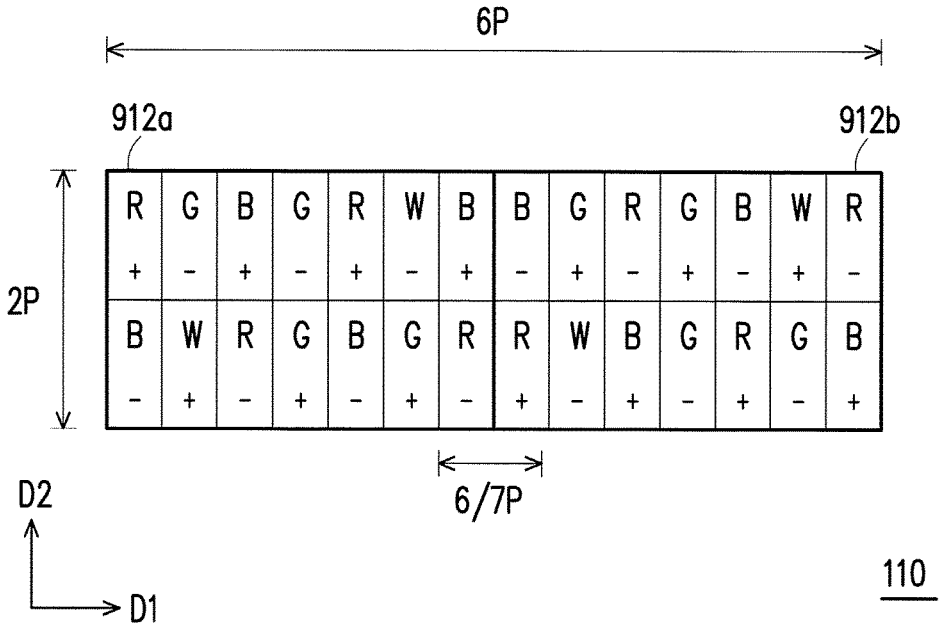
FIG. 9B is a schematic top view of a display panel illustrated according to one embodiment of the invention.
Figure 9C:
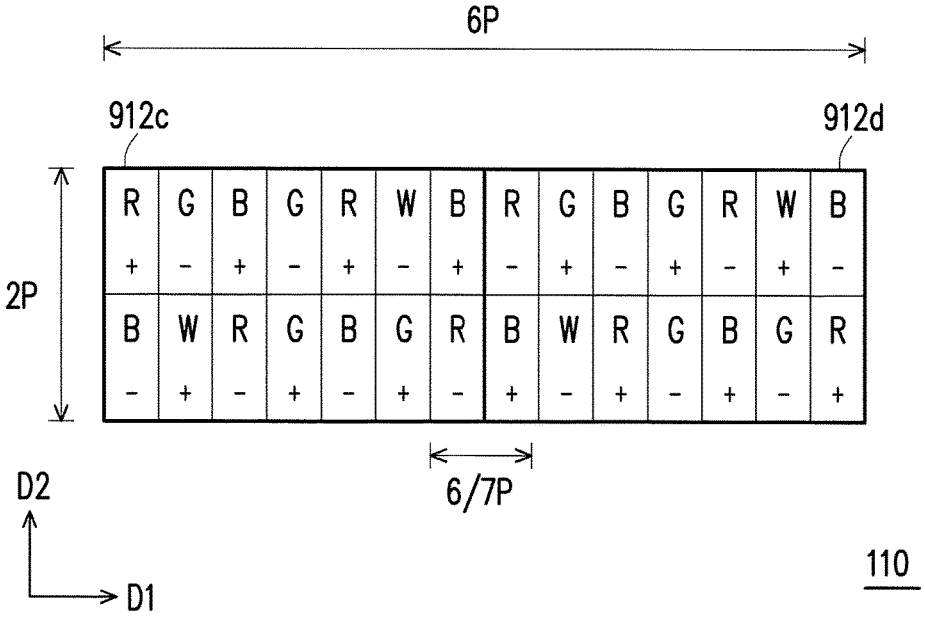
FIG. 9C is a schematic top view of a display panel illustrated according to one embodiment of the invention.

FIG. 9A to FIG. 9C illustrate another embodiment of the sub-pixel repeating units. FIG. 9A is a schematic top view of a sub-pixel repeating unit illustrated according to one embodiment of the invention, FIG. 9B is a schematic top view of a display panel illustrated according to one embodiment of the invention, and FIG. 9C is a schematic top view of a display panel illustrated according to one embodiment of the invention. FIG. 9A illustrates one sub-pixel repeating unit 912; and for the convenience of explanation, FIG. 9B only illustrates an area on the display panel 110 that includes two sub-pixel repeating units 912 (respectively represented by 912*a* and 912*b*), and FIG. 9C only illustrates an area on the display panel 110 that includes two sub-pixel repeating units 912 (respectively represented by 912*c* and 912*d*). Those skilled in the art should be able to understand that, the display panel 110 substantially includes an array constituted by a plurality of sub-pixel repeating units 912.

Using the embodiment of FIG. 9A to provide explanations. The sub-pixel repeating unit 812 is 14 sub-pixels that are arranged into a 7×2 array, which includes four red pixels R, four green pixels G, four blue pixels B and two white pixels W. The sub-pixel repeating unit 912 of the present embodiment is similar to the sub-pixel repeating unit 712 of the embodiment of FIG. 7, and differences therebetween lie in that, the sub-pixel repeating unit 912 of the present embodiment replaces two of the green pixels in the embodiment of FIG. 7 with the white pixels W, and enables the green pixels G and the white pixels W in the same column of the sub-pixel repeating unit 912 to be alternately arranged, so as to enable the adjacent white pixels W on the display panel 110 to form a checkerboard arrangement. Other similar parts may be referred to the previous descriptions, and thus will not be repeated herein. Similarly, with the arrangement provided in the embodiment of FIG. 9A, a spatial frequency of the white pixels W and the green pixels G in the second and sixth columns of the sub-pixel repeating unit 912 can be 1:1.

Next, using FIG. 9B and FIG. 9C to explain two arrangements that are capable of being formed by the sub-pixel repeating units 912 on the display panel 110.

Referring to FIG. 9B, the display panel 110 includes the sub-pixel repeating unit 912*a* and the sub-pixel repeating unit 912*b* thereon, and the sub-pixel repeating unit 912*a* and the sub-pixel repeating unit 912*b* are arranged adjacent to each other along the row direction (i.e., the first direction D1). Similarly, the combination constituted by the sub-pixel repeating unit 912*a* and the sub-pixel repeating unit 912*b* may be arranged repeatedly on the display panel 110 to form the pixel array of the present embodiment, and a length of the said combination in the first direction D1 is, for example, 6P, and a length thereof in the second direction D2 is, for example, 2P. Particularly, in the present embodiment, the sub-pixels of the sub-pixel repeating unit 912*a* are arranged in a same manner as the sub-pixels of the sub-pixel repeating unit 912 of FIG. 9A, while the arrangement of the sub-pixels of the sub-pixel repeating unit 912*b* is to swap the red pixels R with the blue pixels B in the first, third, fifth and seventh columns of the sub-pixel repeating unit 912.

FIG. 9C illustrates another arrangement of the sub-pixel repeating units 912 on the display panel 110. The display panel 110 includes the sub-pixel repeating unit 912*c* and the sub-pixel repeating unit 912*d* thereon, and the sub-pixel repeating unit 912*c* and the sub-pixel repeating unit 912*d* are arranged adjacent to each other along the row direction (i.e., the first direction D1). The present embodiment is similar to the previous embodiment of FIG. 9B, and thus similar parts will not be repeated herein. A difference between the two lies in that, in the present embodiment, the arrangement of the sub-pixels in the sub-pixel repeating units 912*c* and 912*d* is the same as that of the sub-pixels in the sub-pixel repeating unit 912 of FIG. 9A.

Another worth mentioning is that, in the embodiment of FIG. 9B, a largest slit gap SG between two adjacent green pixels G (e.g., the green pixel G in the first row of the sixth column of the sub-pixel repeating unit 912*a* and the green pixel G in the first row of the second column of the sub-pixel repeating unit 912*b*) in the first direction D1 is 6/7 P. Similarly, a largest slit gap SG in the embodiment of FIG. 9C is also 6/7 P. As previously described, if the design requirement of the slit gap SG is to be less than 42 um, then the resolution of the display panel 110 must be more than 500 PPI.

Moreover, in the present embodiment, if the sub-pixel repeating units 912*a* and 912*b* are arranged repeatedly on the display panel 110 according to FIG. 9B, then under such arrangement, four adjacent white pixels W on the display panel 110 may surround into a kite-shape with an aperture slot area SA being $3P^2$ (diagonal lengths thereof in the first direction D1 and the second direction D2 are respectively 3P and 2P). Similarly, the embodiment of FIG. 9C may also be surrounded into a kite-shape having the same area. Therefore, if a design requirement of the aperture slot area SA is to be less than 14112 $um^2$, then the resolution of the display panel 110 would be correspondingly be designed as higher than 350 PPI.

Figure 10A:
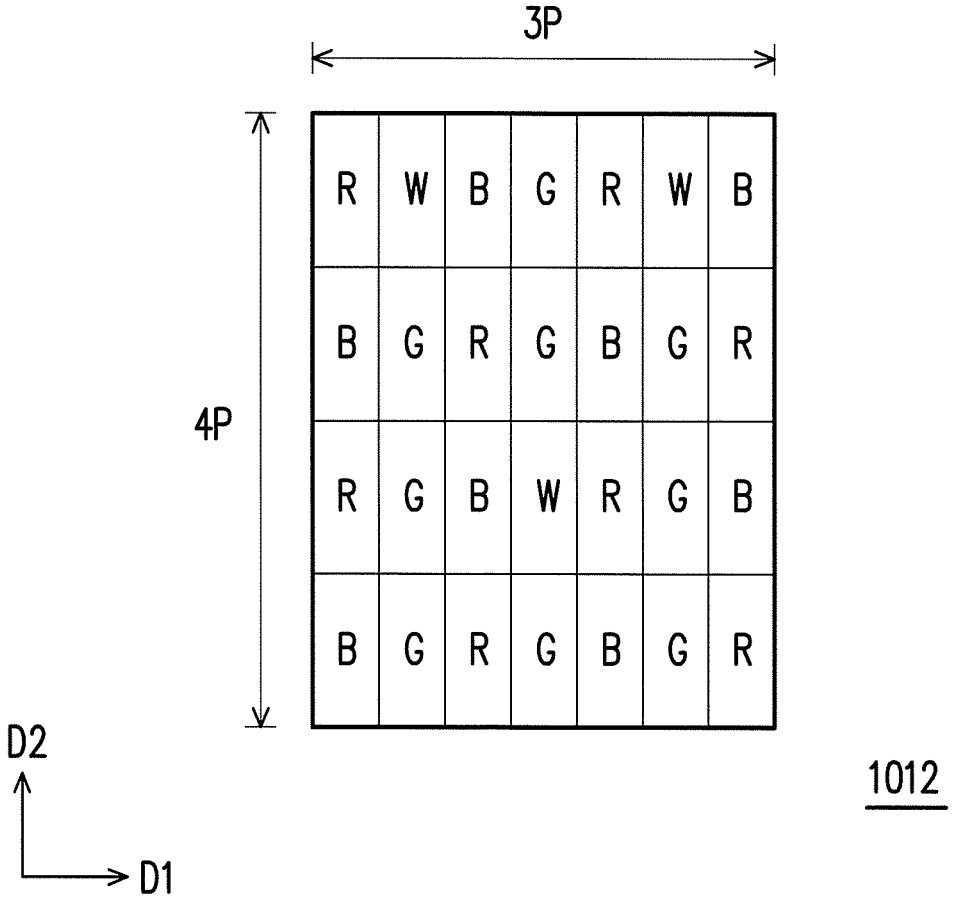
FIG. 10A is a schematic top view of a sub-pixel repeating unit illustrated according to one embodiment of the invention.
Figure 10B:
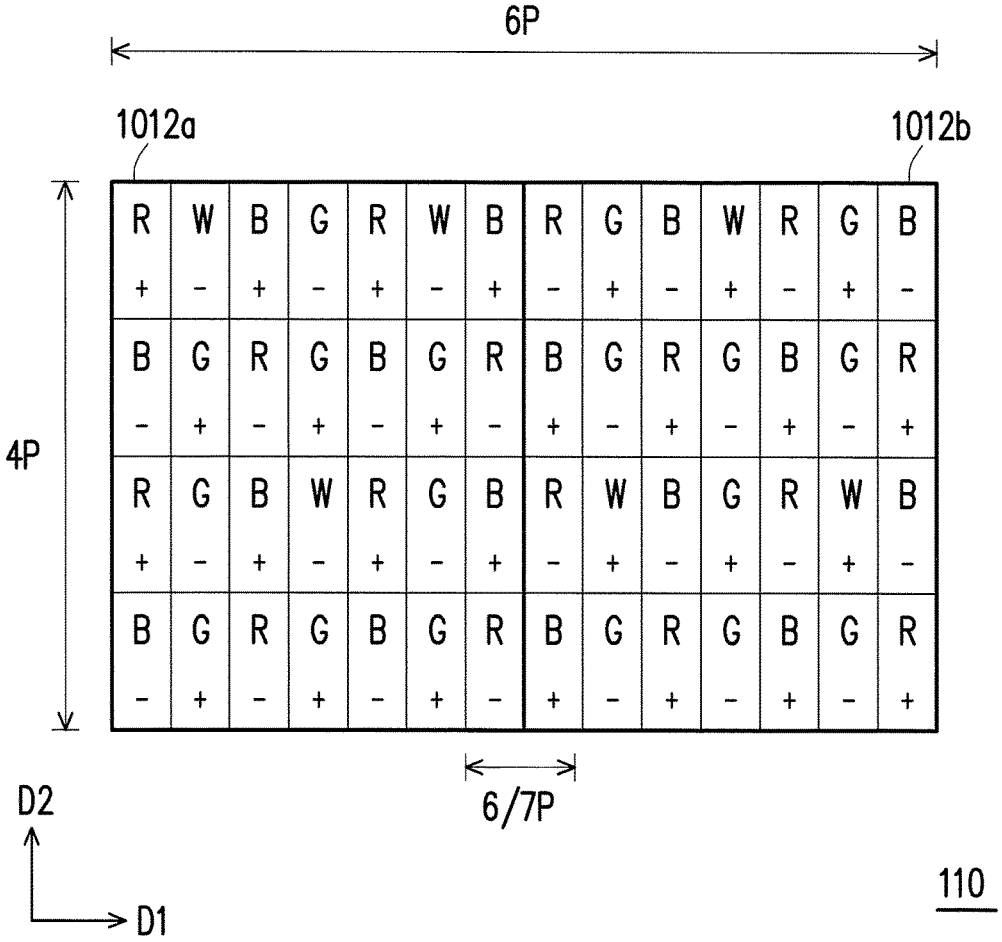
FIG. 10B is a schematic top view of a display panel illustrated according to one embodiment of the invention.

FIG. 10A to FIG. 10B illustrate another embodiment of the sub-pixel repeating units. FIG. 10A is a schematic top view of a sub-pixel repeating unit illustrated according to one embodiment of the invention, and FIG. 10B is a schematic top view of a display panel illustrated according to one embodiment of the invention. FIG. 10A illustrates one sub-pixel repeating unit 1012; and for the convenience of explanation, FIG. 10B only illustrates an area on the display panel 110 that includes two sub-pixel repeating units 1012 (respectively represented by 1012*a* and 1012*b*). Those skilled in the art should be able to understand that, the display panel 110 substantially includes an array constituted by a plurality of sub-pixel repeating units 1012.

Referring to FIG. 10A, the sub-pixel repeating unit 1012 of the present embodiment is 28 sub-pixels that are arranged into a 7×4 array, which includes eight red pixels R, nine green pixels G, eight blue pixels B and three white pixels W. In the present embodiment, a length of the sub-pixel repeating unit 1012 in the first direction D1 is, for example, 3P, and a length thereof in the second direction D2 is, for example, 4P.

As shown in FIG. 10A, the first, third, fifth and seventh columns of the sub-pixel repeating unit 1012 are alternately arranged with the red pixels R and the blue pixels B; and the second, fourth and sixth columns of the sub-pixel repeating unit 1012 are arranged with the white pixels W and the green pixels G with a spatial frequency of 1:3. It is to be explained that, in the present embodiment, the arrangement of the red pixels R and the blue pixels B in the first column is the same as in the fifth column, and the arrangement of the red pixels R and the blue pixels B in the third column is the same as in the seventh column. Moreover, in other embodiment, the arrangements of the first column and the third column can be exchanged, and the arrangements of the fifth column and the seventh column can be exchanged; the invention is not limited thereto.

Specifically, referring to FIG. 10A, in the sub-pixel repeating unit 1012, sequentially from left to right of the first row are the red pixel R, the white pixel W, the blue pixel B, the green pixel G, the red pixel R, the white pixel W, and the blue pixel B; sequentially from left to right of the second row are the blue pixel B, the green pixel G, the red pixel R, the green pixel G, the blue pixel B, the green pixel G, and the red pixel R; sequentially from left to right of the third row are the red pixel R, the green pixel G, the blue pixel B, the white pixel W, the red pixel R, the green pixel G, and the blue pixel B; and sequentially from left to right of the fourth row are the blue pixel B, the green pixel G, the red pixel R, the green pixel G, the blue pixel B, the green pixel G, and the red pixel R.

Next, using FIG. 10B to explain an arrangement that is capable of being formed by the sub-pixel repeating units 1012 on the display panel 110.

Referring to FIG. 10B, the display panel 110 includes the sub-pixel repeating unit 1012*a* and the sub-pixel repeating unit 1012*b* thereon, and the sub-pixel repeating unit 1012*a* and the sub-pixel repeating unit 1012*b* are arranged adjacent to each other along the row direction (i.e., the first direction D1). The combination constituted by the sub-pixel repeating unit 1012*a* and the sub-pixel repeating unit 1012*b* may be arranged repeatedly on the display panel 110 to form the pixel array of the present embodiment. A length of the said combination in the first direction D1 is, for example, 6P, and a length thereof in the second direction D2 is, for example, 4P. It is worth mentioning that, in the present embodiment, the sub-pixels of the sub-pixel repeating unit 1012*a* are arranged in a same manner as the sub-pixels of the sub-pixel repeating unit 1012 of FIG. 10A, while the arrangement of the sub-pixels of the sub-pixel repeating unit 1012*b* is to swap the white pixel W with the green pixel G in the second and fourth columns of the sub-pixel repeating unit 1012, and to swap the white pixel W with the green pixel G in the fourth and sixth columns of the sub-pixel repeating unit 1012.

Similar to the previously embodiments, in the embodiment of FIG. 10B, a largest slit gap SG between two adjacent green pixels G (e.g., the green pixel G in the second row of the sixth column of the sub-pixel repeating unit 1012*a* and the green pixel G in the second row of the second column of the sub-pixel repeating unit 1012*b*) in the first direction D1 is 6/7 P. Thus, as previously described, if the design requirement of the slit gap SG is to be less than 42 um, then the resolution of the display panel 110 must be higher than 500 PPI.

Moreover, in the present embodiment, if the sub-pixel repeating units 1012*a* and 1012*b* are arranged repeatedly on the display panel 110 according to FIG. 10B, then under such arrangement, four adjacent white pixels W on the display panel 110 can surround into a kite-shape with an aperture slot area SA being 30/7 $P^2$ (diagonal lengths thereof in the first direction D1 and the second direction D2 are respectively 15/7 P and 4P). If the design requirement of the aperture slot area SA is to be less than 14112 $um^2$, then the resolution of the display panel 110 would correspondingly be designed as higher than 440 PPI.

In view of the above, the amount N of pixel data being written into one row of the sub-pixel repeating unit 112 may be an integer of more than 2, and those who implement the present embodiment can adaptively decide the value of N based on the requirements of design, so as to determine the amount of the sub-pixels (i.e., 2N+1) included in each row of the sub-pixel repeating unit 112; the invention is not limited thereto. On the other hand, the sub-pixel repeating units 112 may be arranged repeatedly on the display panel 110 or arranged in a side-by-side manner on the display panel 110 (such as in a up-side-down or left-and-right reversed mirror arrangement), or it is also possible to only place the odd-numbered columns or the even-numbered columns of the sub-pixel repeating units 112 into the up-side-down arrangement.

Based on the various sub-pixel arrangements described in the previous embodiments, from the point of view of each of the driving circuits 122_1 to 122_M in the display apparatus 100, the extra sub-pixel may further form a break point at the edge of each of the display regions R_1 to R_M, so that each of the driving circuits 122_1 to 122_M may be used to provide color mixing through merely driving the sub-pixels in its own corresponding display regions R_1 to R_M.

Figure 11:
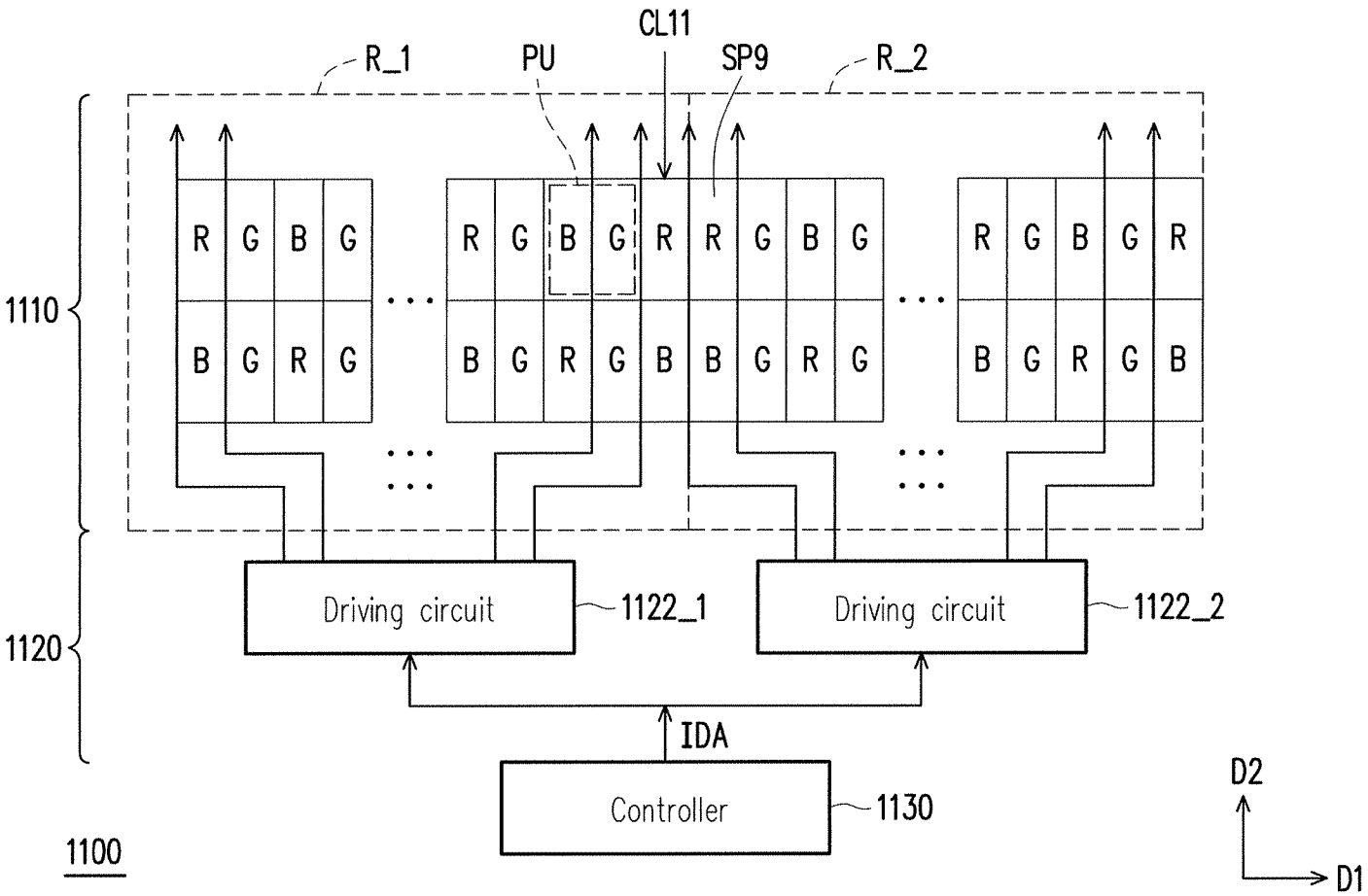
FIG. 11 is a schematic view of a display apparatus illustrated according to one embodiment of the invention.

Using the embodiment of FIG. 11 to provide explanations. FIG. 11 is a schematic view of a display apparatus illustrated according to one embodiment of the invention. The display apparatus 1100 includes a display panel 1110, a driver 1120 and a controller 1130. In the present embodiment, the display panel 1110 includes a plurality of sub-pixel repeating units thereon, the sub-pixel repeating units may, for example, be implemented with the sub-pixel arrangements described in the previously embodiments, and may be grouped into at least two sub-pixel groups along the row direction (i.e., the first direction D1). The present embodiment may group the sub-pixel repeating units into a first sub-pixel group and a second sub-pixel group according to the two display regions R_1 and R_2 included on the display panel 1110. In addition, the driver 1120 includes two driving circuits 1122_1 and 1122_2, and the driving circuits 1122_1 and 1122_2 are respectively configured to drive the first sub-pixel group and the second sub-pixel group on the display panel 1110. For instance, when the controller 1130 writes the display data (which includes 'resolution being 1080×1920') through the driver 1120, the driving circuits 1122_1 and 1122_2 can write 540 groups of pixel data respectively into each row of the display panel 1110, but the invention does not intend to limit the resolution of the written display data. For convenience of description, FIG. 11 merely illustrates the arrangement condition of the sub-pixels nearby the edges of the display regions R_1 and R_2.

In the present embodiment, the last odd-numbered column CL11 of the first sub-pixel group of the display region R_1 can be disposed with extra sub-pixels, so as to be adjacent to the second sub-pixel group of to display region R_2. As shown in FIG. 11, the extra sub-pixels are, for example, the red pixel R and the blue pixel B (respectively referred to as the first second sub-pixel and the second sub-pixel) in the last odd-numbered column CL11 of the display region R_1, and the first sub-pixel and the second sub-pixel may be alternately arranged in the last odd-numbered column CL11 of the first sub-pixel group. It is to be explained that, the last odd-numbered column CL11 of the first sub-pixel group is also referred to the last odd-numbered column in the first sub-pixel group that is adjacent to the sub-pixel repeating unit of the second sub-pixel group. In other words, the first sub-pixel and the second sub-pixel of the present embodiment may be similar to that of the previous embodiments, and thus detailed arrangements thereof can be referred to the previous descriptions.

Next, details regarding how to perform color mixing by enabling the driving circuit 1122_1 to only drive the sub-pixels in the first sub-pixel group through using the extra sub-pixels are provided below.

In one embodiment, in the first sub-pixel group, if a pixel unit (referred to as the first pixel unit) adjacent to the first sub-pixel is being written by one group of pixel data (referred to as the first group of pixel data) among a plurality groups of pixel data, then the driving circuit 1122_1 that is configured to drive the first sub-pixel group may drive the first sub-pixel of the first sub-pixel group according to the first group of pixel data, so as to perform color mixing with the first pixel unit. Similarly, in the first sub-pixel group, when another pixel unit (referred to as the second pixel unit) adjacent to the second sub-pixel is being written by another group of pixel data (referred to as the second group of pixel data) among the plurality of groups of pixel data, then the driving circuit 1122_1 may drive the second sub-pixel of the first sub-pixel group according to the second group of pixel data, so as to perform color mixing with the second pixel unit. As such, when the driving circuits 1122_1 intends to write the pixel data into the sub-pixel of the display region R_1, even if under a condition that a color signal corresponded by the pixel data is unable to be provided directly by its own corresponding sub-pixel and must borrow color from the other sub-pixel adjacent thereto, the driving circuit 1122_1 may still provide the coloring resources through only driving the sub-pixels of the first sub-pixel group.

Using the embodiment of FIG. 11 as an example, in the first sub-pixel group of display region R_1, the red pixel R (the extra sub-pixel, which may also correspond to the first sub-pixel) located in the last odd-numbered column CL11 is adjacent to the pixel unit PU (the first pixel unit); and if the first pixel unit is written by one group of pixel data (referred to as the first group of pixel data) among the plurality groups of pixel data, and the first group of pixel data includes the red pixel data and is unable to be directly displayed by sub-pixels of the pixel unit PU, the driving circuits 1122_1 may drive the red pixel R in the last odd-numbered column CL11 of the first sub-pixel group according to the first group of pixel data, so as to use the red pixel R to perform color mixing with the pixel unit PU without requiring to borrow color from the sub-pixel SP9 (e.g., the red pixel R) in the second sub-pixel group. During the condition when the extra sub-pixel in FIG. 11 is the blue pixel B (the second sub-pixel), the result is similar to the above-described case, and thus will not be repeated. As such, the extra sub-pixel can effectively form a break point between each row of the first sub-pixel group and the second sub-pixel group (i.e., the display regions R_1 and R_2), thereby enabling the driving circuits 1122_1 and 1122_2 to operate independently and thus effectively simplifying the architectural design of the driver 1120.

Figure 12:
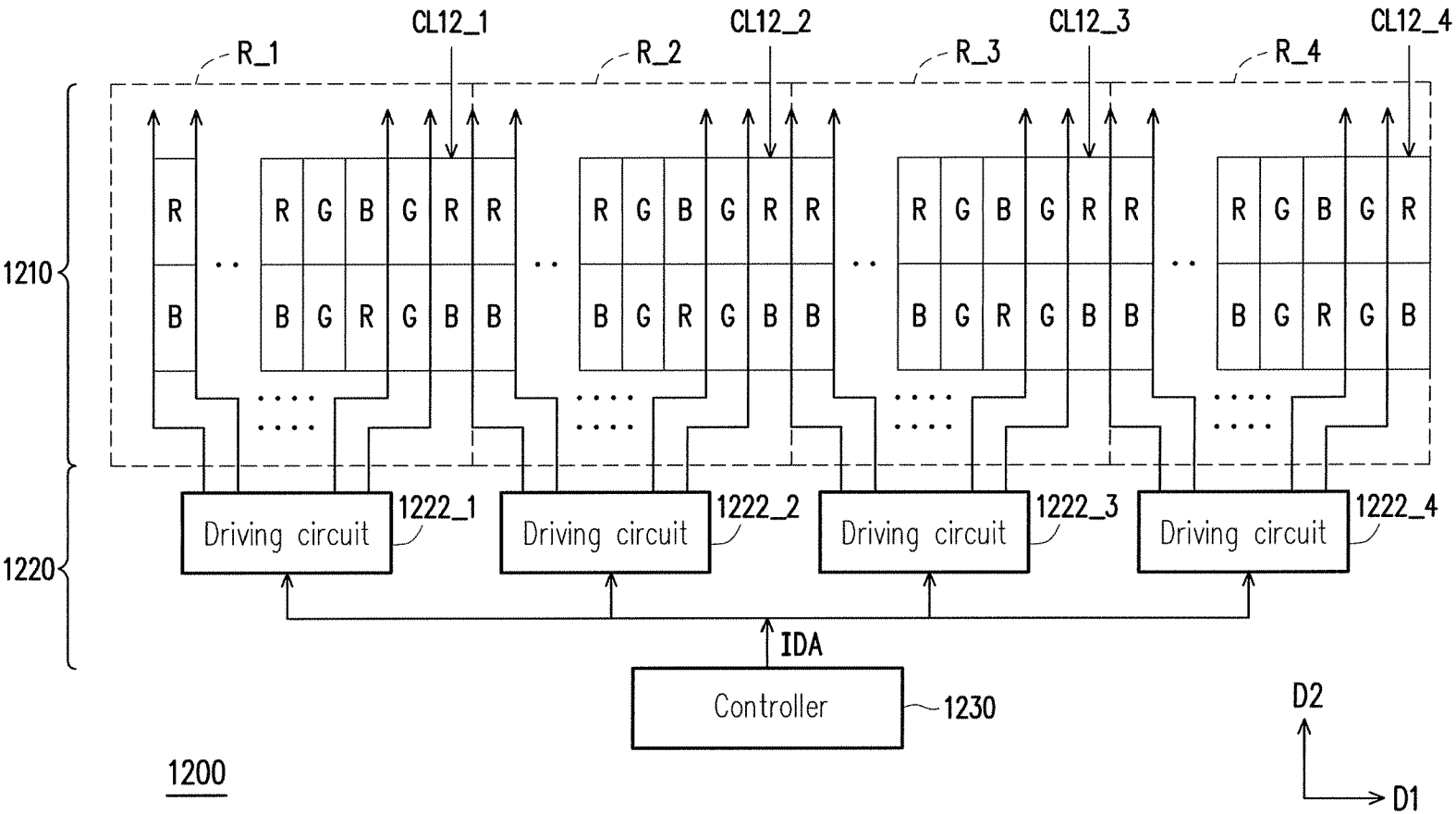
FIG. 12 is a schematic view of a display apparatus illustrated according to one embodiment of the invention.

As shown in another embodiment depicted by FIG. 12, a display apparatus 1200 includes a display panel 1210, a driver 1220 and a controller 1230, the driver 1220 may include four driving circuits 1222_1 to 1222_4, and each of the driving circuits 1222_1 to 1222_4 is configured to respectively drive four sub-pixel groups that are individually corresponded to 4 display regions R_1 to R_4 on the display panel 1110. Similarly, if still using the controller 1230 writing the display data (which includes 'resolution being 1080×1920') through the driver 1220 as an example, then the driving circuits 1222_1 to 1222_4 can write 270 groups of pixel data respectively into each row of the display panel 1210. It is to be explained that, the present embodiment is similar to the previous embodiment, and thus similar parts will not be repeated herein; and a difference between the two lies in that, the last odd-numbered columns CL12_1, CL12_2, CL12_3 and CL12_4 of the sub-pixel groups that are respectively corresponded by the display regions R_1 to R_4 of the present embodiment may be respectively be disposed with an extra sub-pixel so as to respectively form a break point between two adjacent display regions.

In summary, the display panel and the display driver provided in the embodiments of the invention adopt the sub-pixel rendering technology as the basis and add an extra sub-pixel in each row of the sub-pixel repeating unit, and thus enable each of the sub-pixel repeating units to use its own sub-pixels as the coloring resources when the pixel data is written into the sub-pixel repeating unit, and thus it is not necessary to borrow color from the sub-pixel of other sub-pixel repeating unit. In terms of the drivers of the display apparatus, the extra sub-pixel can further form a break point at the edges of the display regions that are respectively driven by each of the drivers, and thus it is not necessary to transfer data between each of the drivers for perform color mixing, thereby simplifying the complicated circuit design of the driving terminals. Moreover, in the embodiments of the invention, by using the design of adding the extra sub-pixel, each row of the sub-pixel repeating unit may further include an odd number of sub-pixels, and thus capable of improving the problem of display screen flickering caused by same colored sub-pixels having same polarity.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, comprising:

a plurality of sub-pixel repeating units, arranged repeatedly to form a pixel array, and each row of each of the sub-pixel repeating units comprising:

an odd number of sub-pixels, comprising a plurality of pixel units, where every two sub-pixels are regarded as one of the pixel units and another sub-pixel is added at the last column of each of the sub-pixel repeating units, and the odd number of sub-pixels being respectively written to by N groups of pixel data, that the N groups of pixel data include data to be displayed by being respectively written into the sub-pixels, wherein the amount of the sub-pixels in one row of each of the sub-pixel repeating units is (2N+1), wherein N is the amount of groups of the pixel data and an integer of equal to or more than 2, wherein each odd-numbered column of each of the sub-pixel repeating units of the pixel array comprises the sub-pixels of two different colors, which are alternately arranged in each odd-numbered column of each of the sub-pixel repeating units of the pixel array, wherein a group of pixel data in the N groups of pixel data includes image signals of three colors, including red, green and blue colors, and each of the pixel units is constituted by the sub-pixels of two of four colors that are configured to display red, green, blue and white colors.

2. The display panel as recited in claim 1, wherein on the display panel, the sub-pixels of a same color respectively have different polarities.

3. The display panel as recited in claim 1, wherein each of the sub-pixel repeating units comprises the sub-pixels of three different colors, each odd-numbered column of each of the sub-pixel repeating units comprises at least one first color sub-pixel and at least one third color sub-pixel for being staggeredly arranged, and each even-numbered column of each of the sub-pixel repeating units comprises at least one second color sub-pixel so as to form a striped arrangement.

4. The display panel as recited in claim 3, wherein the first color sub-pixel, the second color sub-pixel and the third color sub-pixel are respectively one of a red sub-pixel, a green sub-pixel and a blue sub-pixel.

5. The display panel as recited in claim 1, wherein each of the sub-pixel repeating units comprises the sub-pixels of four different colors, each odd-numbered column of each of the sub-pixel repeating unit comprises at least one first color sub-pixel and at least one third color sub-pixel for being staggeredly arranged, and at least one even-numbered column of each of the sub-pixel repeating units comprises at least one second color sub-pixel and at least one fourth color sub-pixel for being arranged.

6. The display panel as recited in claim 5, wherein a spatial frequency of the second color sub-pixel and the fourth color sub-pixel in the at least one even-numbered column of each of the sub-pixel repeating units is 1:1.

7. The display panel as recited in claim 5, wherein a spatial frequency of the second color sub-pixel and the fourth color sub-pixel in the at least one even-numbered column of each of the sub-pixel repeating units is 1:3.

8. The display panel as recited in claim 5, wherein the first color sub-pixel, the second color sub-pixel, the third color sub-pixel and the fourth color sub-pixel are respectively one of a red sub-pixel, a green sub-pixel, a blue sub-pixel and a white sub-pixel.

9. A display driver, configured to drive a display panel, wherein the display panel comprises a plurality of sub-pixel repeating units, and the sub-pixel repeating units are divided into at least two sub-pixel groups, the display driver comprising:

a first driving circuit, configured to drive a first sub-pixel group in the sub-pixel groups; and a second driving circuit, configured to drive a second sub-pixel group adjacent to a last odd-numbered column of one of the sub-pixel repeating units of the first sub-pixel group in the sub-pixel groups, wherein each row of each of the sub-pixel repeating units comprises:

an odd number of sub-pixels, comprising a plurality of pixel units, where every two sub-pixels are regarded as one of the pixel units and another sub-pixel is added at the last column of each of the sub-pixel repeating units, and the odd number of sub-pixels being respectively written to by N groups of pixel data, that the N groups of pixel data include data to be displayed by being respectively written into the sub-pixels, wherein the amount of the sub-pixels in one row of each of the sub-pixel repeating units is (2N+1), wherein N is the amount of groups of the pixel data and an integer of equal to or more than 2, wherein the last odd-numbered column of the sub-pixel repeating unit of the first sub-pixel group comprises a first sub-pixel and a second sub-pixel, and in the first sub-pixel group, a first pixel unit adjacent to the first sub-pixel is written by a first group of pixel data in the N groups of pixel data, the first driving circuit drives the first sub-pixel of the first sub-pixel group according to the first group of pixel data, so as to color mix the first sub-pixel with the first pixel unit, and in the first sub-pixel group, a second pixel unit adjacent to the second sub-pixel is written by a second group of pixel data in the N groups of pixel data, and the first driving circuit drives the second sub-pixel of the first sub-pixel group according to the second group of pixel data, so as to color mix the first sub-pixel with the second pixel unit, wherein a group of pixel data in the N groups of pixel data includes image signals of three colors, including red, green and blue colors, and each of the pixel units is constituted by the sub-pixels of two of four colors that are configured to display red, green, blue and white colors.

10. The display driver as recited in claim 9, wherein the sub-pixel repeating units are arranged repeatedly to form a pixel array, the sub-pixel repeating units are divided into the at least two sub-pixel groups along a row direction.

11. The display driver as recited in claim 9, wherein the first sub-pixel and the second sub-pixel are of different colors.

12. The display driver as recited in claim 9, wherein the sub-pixel repeating units comprise a first sub-pixel repeating unit and a second sub-pixel repeating unit, the last odd-numbered column of the first sub-pixel repeating unit is arranged to be adjacent to the second sub-pixel repeating unit, and an arrangement of the sub-pixels in the first sub-pixel repeating unit is the same as that of the sub-pixels in the second sub-pixel repeating unit.

13. The display driver as recited in claim 12, wherein odd-numbered rows and even-numbered rows in the second sub-pixel repeating unit are staggeredly arranged with odd-numbered rows and even-numbered rows in the first sub-pixel repeating unit.

14. The display driver as recited in claim 9, wherein on the display panel, the sub-pixels of a same color respectively have different polarities.

15. The display driver as recited in claim 9, wherein each odd-numbered column of each of the sub-pixel repeating units comprises the sub-pixels of two different colors, which are alternately arranged in each odd-numbered column.

16. The display driver as recited in claim 9, wherein each of the sub-pixel repeating units comprises the sub-pixels of three different colors, each odd-numbered column of each of the sub-pixel repeating units comprises at least one first color sub-pixel and at least one third color sub-pixel for being staggeredly arranged, and each even-numbered column of each of the sub-pixel repeating units comprises at least one second color sub-pixel so as to form a striped arrangement.

17. The display driver as recited in claim 16, wherein the first color sub-pixel, the second color sub-pixel and the third color sub-pixel are respectively one of a red sub-pixel, a green sub-pixel and a blue sub-pixel.

18. The display driver as recited in claim 9, wherein each of the sub-pixel repeating units comprises the sub-pixels of four different colors, each odd-numbered column of each of the sub-pixel repeating unit comprises at least one first color sub-pixel and at least one third color sub-pixel for being staggeredly arranged, and at least one even-numbered column of each of the sub-pixel repeating unit comprises at least one second color sub-pixel and at least one fourth color sub-pixel for being arranged.

19. The display driver as recited in claim 18, wherein a spatial frequency of the second color sub-pixel and the fourth color sub-pixel in the at least one even-numbered column of each of the sub-pixel repeating units is 1:1.

20. The display driver as recited in claim 18, wherein spatial frequencies of the second color sub-pixel and the fourth color sub-pixel in the at least one even-numbered column of each of the sub-pixel repeating unit is 1:3.

21. The display driver as recited in claim 18, wherein the first color sub-pixel, the second color sub-pixel, the third color sub-pixel and the fourth color sub-pixel are respectively one of a red sub-pixel, a green sub-pixel, a blue sub-pixel and a white sub-pixel.

* * * * *